US008152617B2

(12) United States Patent
Katz

(10) Patent No.: US 8,152,617 B2
(45) Date of Patent: Apr. 10, 2012

(54) CARD GAME INTERFACE

(76) Inventor: Marcus A. Katz, Miami Beach, FL (US)

( * ) Notice: Subject to any disclaimer, the term of this patent is extended or adjusted under 35 U.S.C. 154(b) by 569 days.

(21) Appl. No.: 12/348,150

(22) Filed: Jan. 2, 2009

(65) Prior Publication Data

US 2009/0176547 A1 Jul. 9, 2009

Related U.S. Application Data

(63) Continuation-in-part of application No. 12/090,851, filed as application No. PCT/US2007/072792 on Jul. 3, 2007, now Pat. No. 8,087,985.

(51) Int. Cl.
*A63F 9/24* (2006.01)

(52) U.S. Cl. ..... 463/13; 273/292

(58) Field of Classification Search ..... 463/10–13, 463/20; 273/292
See application file for complete search history.

(56) References Cited

U.S. PATENT DOCUMENTS

| | | | | |
|---|---|---|---|---|
| 5,362,064 | A | 11/1994 | Lofink et al. | |
| 5,395,119 | A | 3/1995 | Jacob et al. | |
| 5,876,283 | A | 3/1999 | Parra et al. | |
| 5,957,459 | A | 9/1999 | Chae | |
| 6,789,801 | B2 | 9/2004 | Snow | |
| 6,926,280 | B2 * | 8/2005 | Abuan | 273/292 |
| 2003/0069058 | A1 | 4/2003 | Byrne | |
| 2003/0114209 | A1 * | 6/2003 | Ritner et al. | 463/11 |
| 2003/0190941 | A1 | 10/2003 | Byrne | |
| 2004/0053664 | A1 | 3/2004 | Byrne | |
| 2005/0012273 | A1 * | 1/2005 | Bruno et al. | 273/292 |
| 2005/0127606 | A1 | 6/2005 | Snow et al. | |
| 2005/0197183 | A1 | 9/2005 | Walker et al. | |
| 2005/0221885 | A1 | 10/2005 | Walker et al. | |
| 2005/0261973 | A1 | 11/2005 | Van Luchene | |
| 2005/0288096 | A1 | 12/2005 | Walker et al. | |
| 2006/0003826 | A1 | 1/2006 | Walker et al. | |
| 2006/0003830 | A1 | 1/2006 | Walker et al. | |

(Continued)

FOREIGN PATENT DOCUMENTS

| | | | |
|---|---|---|---|
| WO | WO2008039835 | A2 | 4/2008 |
| WO | WO2008101204 | A1 | 8/2008 |

OTHER PUBLICATIONS

PCT Notification of Transmittal of the International Search Report and the Written Opinion of the International Searching Authority, or the Declaration in PCT/US07/72792 dated Oct. 3, 2008.

(Continued)

*Primary Examiner* — Brook Kebede
(74) *Attorney, Agent, or Firm* — Thibault Patent Group

(57) ABSTRACT

Among other things, a system includes a card-game table that includes visually defined regions on a surface of the card-game table to accommodate one or more card hands of each of one or more participants in addition to one or more separate card hands of a house entity. An analysis system is associated with the card table and configured to receive data representing at least a value associated with each card from a group of cards dealt by a dealer to the one or more hands of each participant in addition to the one or more separate hands of the house; process the received data to calculate scores and odds for the one or more hands of each participant in addition to the one or more separate hands of the house, and generate an output signal indicative of the calculated scores and odds.

28 Claims, 13 Drawing Sheets

U.S. PATENT DOCUMENTS

| | | | |
|---|---|---|---|
| 2006/0025207 | A1 | 2/2006 | Walker et al. |
| 2006/0035696 | A1 | 2/2006 | Walker et al. |
| 2006/0226605 | A1 | 10/2006 | Kenny |
| 2007/0032283 | A1 | 2/2007 | Chun |
| 2007/0057466 | A1 | 3/2007 | Soltys et al. |
| 2007/0075495 | A1 | 4/2007 | Mostashari |
| 2007/0184889 | A1 | 8/2007 | Walker et al. |
| 2007/0210515 | A1 | 9/2007 | Schubert et al. |
| 2007/0213124 | A1 | 9/2007 | Walker et al. |
| 2007/0276537 | A1 | 11/2007 | Walker et al. |
| 2008/0111300 | A1 | 5/2008 | Czyzewski et al. |
| 2008/0146311 | A1 | 6/2008 | Walker et al. |
| 2008/0201213 | A1 | 8/2008 | Lee et al. |
| 2008/0202889 | A1 | 8/2008 | Breitenbach et al. |
| 2008/0248865 | A1 | 10/2008 | Tedesco et al. |
| 2008/0274798 | A1 | 11/2008 | Walker et al. |
| 2008/0305862 | A1 | 12/2008 | Walker et al. |
| 2008/0318656 | A1 | 12/2008 | Walker et al. |

OTHER PUBLICATIONS

Examiner's First Report in Australian Patent Application No. 200901475 dated Mar. 2, 2010.

Examination Report in Singapore Patent Application No. 200902352-4 dated Jun. 4, 2010.

PCT Notification of Transmittal of the International Search Report and the Written Opinion of the International Searching Authority, or the Declaration in PCT/US2009/030012 dated Oct. 5, 2009.

File history in U.S. Appl. No. 60/868,470, filed Dec. 4, 2006.

File history in U.S. Appl. No. 60/890,328, filed Feb. 16, 2007.

File history in U.S. Appl. No. 60/943,171, filed Jun. 11, 2007.

File history in U.S. Appl. No. 61/012,230, filed Dec. 7, 2007.

File history in U.S. Appl. No. 61/020,470, filed Jan. 11, 2008.

File history in U.S. Appl. No. 61/023,290, filed Jan. 24, 2008.

File history in U.S. Appl. No. 61/024,827, filed Jan. 30, 2008.

File history in U.S. Appl. No. 61/028,555, filed Feb. 14, 2008.

* cited by examiner

CARD GAME INTERFACE

CLAIM OF PRIORITY

This application is a continuation in part of U.S. patent application Ser. No. 12/090,851, filed on May 1, 2009, now U.S. Pat. No. 8,087,985 which claims priority to PCT Application No. PCT/US2007/72792, filed on Jul. 3, 2007, the entire contents of which are hereby incorporated by reference.

TECHNICAL FIELD

The subject matter described herein relates to casino card games.

BACKGROUND

In card games, such as blackjack, each participant is dealt his or her hand(s). As the number of participants increases, the number of hands dealt by a dealer also increases. The dealer is burdened with the task of keeping track of the score and betting amount for each participant. The increase in the number of hands dealt and the degree of complexity for different card games can cause additional burden on the dealer to avoid mistakes.

SUMMARY

Techniques and systems are disclosed for implementing an interface to manage game play for various card games. For example, a system is described for providing an interface for automatically detecting the type and amount of bets made by each participant in a card game. Also, the interface can determine whether to deal one or more hands of cards to each participant. While the techniques and systems described in this application are applicable to any card games where each participant can receive his/her own hand(s) of cards, a non-traditional version of Baccarat is used for illustrative purposes. For example, a version of Baccarat is described that allows each game participant the opportunity to play one hand against the House or to play two hands against the House's two hands. In addition, each game participant is able to place additional bets on each of their hands with the odds associated with each bet tracked by a system described in this specification. Additional bets, if allowed by the House rules, may only be placed before the last card of each hand is dealt (e.g., first additional bet before the third card is dealt to a Player hand and a second additional bet before the third card is dealt to a Bank hand.

In one aspect, a system includes a card-game table that includes visually defined regions on a surface of the card-game table to accommodate one or more card hands of each of one or more participants in addition to one or more separate card hands of a house entity. An analysis system is associated with the card table. The analysis system is configured to receive data representing at least a value associated with each card from a group of cards dealt by a dealer to the one or more hands of each participant in addition to the one or more separate hands of the house; process the received data to calculate scores and odds for the one or more hands of each participant in addition to the one or more separate hands of the house, and generate an output signal indicative of the calculated scores and odds. A display device is in communication with the analysis system to receive the generated output signal and display the received output signal as a visual indication of the calculated score and odds.

Implementations can optionally include one or more of the following features. The system can include a card shuffler associated with the card-game table to shuffle the group of cards before the dealer deals two or more of the cards to each of the one or more hands for each participant and the house. A card reader can be in communication with each card dealt by the dealer; and send the data representing the identified value to the analysis system. The analysis system can be configured to process the received data after two of the cards are dealt to each hand for each participant and the house. The one or more hands for each participant can include a baccarat player hand for each participant and the one or more hands for the house can include a baccarat bank hand. The analysis system can calculate the scores that include a two-card score for the player hand of each participant and a two-card score for the house's bank hand based on the processing of the received data. The analysis system can determine whether the calculated two-card scores represent a final result for the player hand of each participant. The analysis system can be configured to perform operations including when the analysis system determines that the calculated two-card scores do not represent a final result, the analysis system can determine whether a third card should be dealt to the player hand of each participant; and when a third card is dealt to the player hand of each participant, the analysis system can calculate a three-card score for the player hand of each participant and determine whether the calculated three-card score represents a final result.

Implementations can optionally include one or more following features. The analysis system can be configured to perform operations including when the system determines that the calculated three-card score for the player hand of each participant does not represent a final result, perform the following: determine whether the house's bank hand should receive a third card; and when a third card is dealt to the house's bank hand, calculate a three-card score for the house's bank hand and compare the calculated three-card score for the player hand for each participant against the three-card score for the house's bank hand to determine a final result. The analysis system can be configured to process the received data after two of the cards are dealt to each of the one or more hands for each participant and the house, wherein the one or more hands for each participant include a baccarat bank hand for each participant and the one or more hands for the house include a baccarat player hand. The analysis system can calculate the scores that include a two-card score for the bank hand of each participant and a two-card score for the house's player hand based on the processing of the received data; and determine whether the calculated two-card scores represent a final result for the bank hand of each participant. The analysis system can be configured to perform operations including: when the analysis system determines that the calculated two-card scores do not represent a final result, determine whether a third card should be dealt to the house's player hand; when a third card is dealt to the house's player hand, calculate a three-card score for the house's player hand and determine whether the calculated three-card score represents a final result for the bank hand of each participant. The analysis system can be configured to perform operations including: when the analysis system determines that the calculated three-card score for the player hand of the house does not represent a final result, perform the following: determine whether the bank hand of each participant should receive a third card; and when a third card is dealt to the bank hand of each participant, calculate a three-card score for the bank hand of each participant and compare the calculated three-card score for the house's player hand against the three-card score for the bank hand of each participant to determine a final result.

Implementations can optionally include one or more of the following features. The analysis system can be configured to determine whether to accept one or more additional bets for the one or more hands of each participant based on a policy of a casino or an online betting establishment. The analysis system can be configured to determine whether to accept one or more additional bets for the one or more hands of each participant based on the calculated odds that include real time calculations of a probability of the third card having a value from any one of 0, 1, 2, 3, 4, 5, 6, 7, 8 and 9. The analysis system can be configured to determine whether to accept the one or more additional bets for the one or more hands of each participant based on the calculated odds that include real time calculations of the probability of the third card having a value from any one of 0, 1, 2, 3, 4, 5, 6, 7, 8 and 9 and final result of any bet being winning bet or losing bet. The display device can include a liquid crystal display positioned at or near the baccarat table so as to be viewable by all of the one or more participants. The system can include one or more remote devices in communication with the analysis system to receive the generated output signal. The one or more remote devices can be configured to perform operations including: receive an input from one or more users different from the one or more participants, wherein the input represents a request to place a bet on a select one of the one or more hands of each participant and the house; and send the input representing the request to the analysis system. The one or more remote devices can be located at a remote location and in communication with the analysis system over a network connection.

Implementations can optionally include one or more of the following features. The display device can include a separate display unit for each participant so as to provide participant specific information. The separate display unit can include a touch-screen to receive bets from each respective game participant, wherein the received bets can include bets on any of the one or more card hands of each game participant. The display device can include multiple display regions configured to display the output signal so as to provide the scores and odds for each participant in separate one of the display regions viewable by each participant. An input sensor can be associated with each visually defined region on the surface of the card-game table to detect user input that represents one or more types of bets and a value of the one or more types of bets, wherein the input sensor is in communication with the analysis system to send data indicative of the user input to the analysis system. The input sensor can include a pressure sensor. One or more visual indicators can be associated with each visually defined region on the surface of the card-game table to provide one or more visual indications of whether each participant should receive the one or more hands. The one or more visual indicators can be in communication with the analysis system to receive a control signal from the analysis system, and the one or more visual indicators can provide the one or more visual indications of whether each participant should receive the one or more hands in response to the received control signal. The analysis system can generate the control signal based on the data received from the input sensor. The system can include an image capture device in communication with the analysis system to capture live video data of a card game at the card-table; and one or more slot machines to receive the captured live video data. The one or more slot machines can be configured to receive bets from a user different from the participants based on the received video data. The live video data can include the data representing at least a value associated with each card from a group of cards dealt by a dealer; and the analysis system can receive the data from the image capture device. The image capture device can include a camera to capture still or video images.

Implementations can optionally include one or more of the following features. The analysis system can be configured to perform operations including: receive one or more initial bets from one or more participants; based on the received one or more bets, determine a number of hands to deal to each participant; signal the dealer to deal two cards to each of the determined number of hands of each participant in addition to separate hands for a house entity; calculate a two-card score for each hand dealt to each participant and house; and determine whether the calculated two-card score represents a final result for each hand of each participant. The analysis system can be configured to determine the number of hands to deal to each participant comprising determining whether to deal a baccarat player hand and a baccarat bank hand to each participant. When the analysis system determines that the calculated two-card scores do not represent a final result, the analysis system can determine whether each hand of each participant should receive a third card; and when a third card is dealt to at least one hand of each participant, the analysis system can calculate a three-card score for the hand of each participant that received the third card and determine whether the calculated three-card score represents a final result.

When the analysis system determines that the calculated three-card score does not represent a final result, the analysis system can perform the following: determine whether at least one of the house entity's hand should receive a third card; and when a third card is dealt to at least one of the house entity's hand, calculate a three-card score for the house entity's hand that received the third card and comparing the calculated three-card score for the hand for each participant against the three-card score for the house's hand to determine a final result. The analysis system can determine whether to accept one or more additional bets for any of the hands of any participant based on a policy of a casino or an online betting establishment.

In another aspect, a system includes a card-game table comprising visually defined regions on a surface of the card-game table to accommodate one or more hands of each of one or more participants in addition to one or more separate hands of a house. A card shuffler is associated with the card-game table to shuffle multiple cards before a dealer deals two or more of the shuffled cards to each hand for each participant. A card reader is in communication with the card shuffler to identify a value associated with each of the shuffled cards dealt by the dealer to the one or more hands of each participant in addition to the one or more separate hands of the house. An analysis system is in communication with the card reader to perform operations including receive data from the card reader, wherein the received data represents at least the identified value associated with each of the shuffled cards dealt by the dealer to the one or more hands of each participant in addition to the one or more separate hands of the house; process the received data to calculate scores and odds for the one or more hands of each participant in addition to the one or more separate hands of the house, and generate an output signal indicative of the calculated scores and odds.

Implementations can optionally include one or more of the following features. The analysis system can include a display device in communication with the analysis system to perform operations including: receive the output signal, and display the received output signal to provide a visual indication of the scores and odds.

In another aspect, a system supporting game play of a card game, wherein a first party and one or more participants take part in the card game and one or more cards are dealt to the first party and to the one or more participants in at least one round, the at least one participant places a bet on an outcome of at least part of the card game. The system includes a card reader which identifies a value associated with a card being dealt. An analysis system is in communication with the card reader. The analysis system receives data representing the value associated with a card being dealt, wherein after at least a first round of cards are dealt the analysis system calculates odds for each bet placed by one of the participants based on a predefined set of rules and the data received from the card reader. A display system is in communication with the analysis system, wherein the display system displays the odds calculated by the analysis system.

Implementations can optionally include one or more of the following features. In the system, the predefined set of rules can include rules of baccarat providing additional bet opportunities. The analysis system can output a modified signal to the display system if the odds for a certain bet are 0% or 100%, i.e. the participant has lost or won the bet. The display system comprises a separate display unit for each participant and wherein optionally the display unit provides the participant with his or her scores and other participant's scores calculated by the analysis system and/or data related to participant's history of betting. The system can include an input sensor system that includes one or more input sensors attributed to each participant, wherein the input sensors detect whether the participant has placed one or more bets and determines which kind of predefined bets have been placed, and wherein the input sensor system communicates the result of the detection to the analysis system. The system can include one or more visual indicators associated with each participant, wherein the analysis system determines, based on the data received from the card reader, the data received from the input sensor system and the predefined set of rules, whether one or more cards have to be dealt and controls the visual indicators to provide a visual indication for those positions to which the one or more cards have to be dealt. After at least a first round of cards are dealt the analysis system can determine whether or not to offer additional betting options to the participant based on the bets previously placed, the predefined set of rules and the data received from the card reader. Terms for additional betting options can be determined by the analysis system based on the calculated odds, the predefined set of rules and predefined margin parameters. The analysis system can provide data related to the offer of additional betting options to the display system. The data related to the offer of additional betting options can be displayed on the display unit for the participant to which the additional betting option is offered. The system can include a spectator system being in communication with the analysis system to receive and/or transmit data from the analysis system, wherein the spectator system enables a spectator to place a bet related to the one or more cards of a participant. The spectator system can include one or more handheld devices assigned to each spectator. The analysis system can determine whether a participant or the spectator has won or lost based on the predefined set of rules and provides final result data to the display system optionally including wins and or losses. The card reader can include an image capture device to capture live video data of the card game including the value associated with the card being dealt. The spectator system can include at least one slot machine to perform operations including receive the captured live video data; determine whether the spectator has won or lost based on the predefined set of rules and received live video data; and provide final result data to the spectator optionally including wins and or losses.

Similarly, systems are also described that may include a processor and a memory coupled to the processor. The memory may encode one or more programs that cause the processor to perform one or more of the techniques described herein.

The subject matter described herein can optionally provide one or more of the following advantages. For example, the dealer at a casino does not need to personally keep track of the bets placed by each participant because the system described in this specification can automatically detect the bets placed by each participant. Also, the system described in this specification can detect the cards dealt to each participant and keep track of the score for each participant. In addition, the system described in this specification can provide a personal display for each participant so as to display individualized information to each participant for each participant's view.

Also, the systems described in this specification can enable each game participant, not just the participant placing the highest bet on Player and Bank, to enjoy the various rituals of looking at his or her own cards on each hand played. In addition, the systems described in this specification can be implemented with end-user devices that allow persons not sitting at the table to place bets on games shown on a display device, such as regular or big screen TVs, computers or on the end-user devises. For example, these persons are not the participants, but may be spectators (on site or off site spectators) to the Baccarat game described in this specification.

The systems and techniques described in this specification may greatly enhance the enjoyment of the game by the game participants and spectators as well as improve the house margin due to increased play. The systems and techniques described in this specification can allow each game participant and others not at the card game table to place multiple bets on each hand of each participant based on dynamic odds of winning as game progresses. Furthermore, the systems and techniques described in this specification can provide opportunity to place additional bets on BANK, PLAYER and TIE based on changing odds to make the game of Baccarat far more challenging and fun for the game participants. In addition, the systems and techniques described in this specification can enable each participant and others not at the card game table to place additional bets to provide additional play and revenues for casinos.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Techniques and systems are disclosed for implementing an interface to manage game play for various card games. For example, a system is described for providing an interface for automatically detecting the type and amount of bets made by each participant in a card game. Also, the interface can determine whether to deal one or more hands of cards to each participant. While the techniques and systems described in this application are applicable to any card games where each participant can receive his/her own hand(s) of cards, non-traditional versions of Baccarat and Blackjack are used for illustrative purposes.

Figure 1:
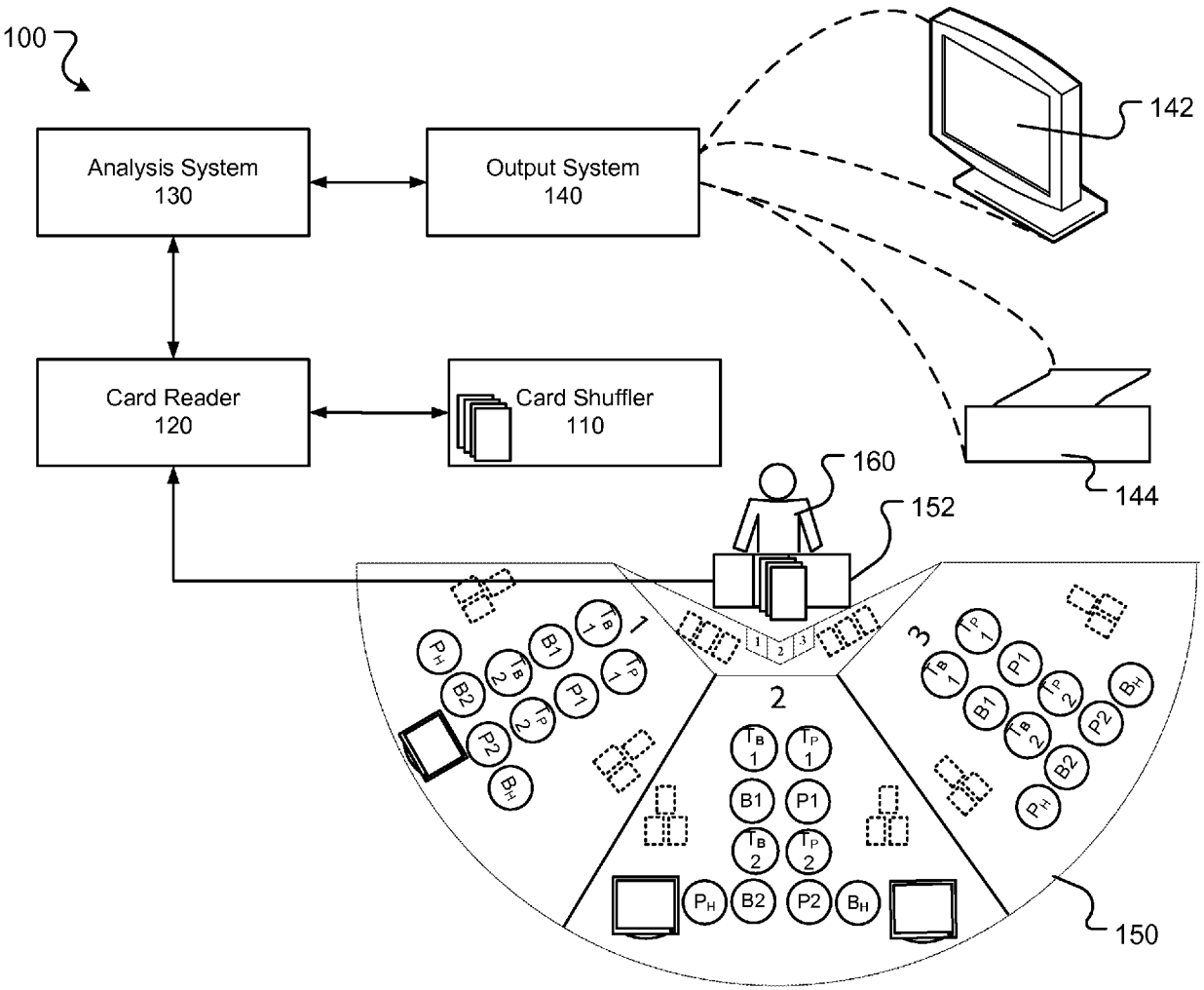
FIG. 1 shows an example system for implementing multiple hands for each game participant.

FIG. 1 shows an example system 100 for performing the techniques described in this specification. The system 100 includes a card shuffler 110, a card reader 120, an analysis system 130, an output system 140 and a table 150.

The card shuffler 110 can include an electronic shuffler that automatically shuffles multiple decks of cards. The card shuffler 110 can include an off the shelf unit. A dealer 160 can use the card shuffler 110 to shuffle the decks of cards before dealing the required hands according to the house rules.

The card reader 120 can include an electronic reading system, such as an optical reader for recognizing the face value of each card. Similar to the card dealing/shuffling system 110, the card reader 120 can be an off the shelf unit. The card reader 120 can be designed to communicate directly with the card dealing/shuffling system 110 to read or otherwise obtain the value of each card being dealt by the dealer 160 as the card leaves the card dealing/shuffling system 110. For example, an optical reader or similar device can be attached to the card dealing/shuffling system 110, and the card reader can obtain the scanned value of cards in the card dealing/shuffling system 110. Also, the card dealing/shuffling system 110 can include a card holder, such as a shoe that holds one or more decks of cards. The card holder can hold cards before or after the cards are automatically shuffled by the dealing/shuffling system 110 or manually shuffled by the dealer 160. The dealing/shuffling system 110 can shuffle, shuffle and hold the cards or just hold the cards. In implementations where the dealing/shuffling system 110 is merely holding the cards, the dealer 160 can manually shuffle the cards.

In some implementations, the card reader 120 can interface with the table 150 to read the value of each card being dealt by the dealer. For example, the table 150 can include one or more scanning interfaces 152 to scan each card before or after the card is dealt by the dealer 160. The card reader 120 can communicate with the one or more scanning interfaces 152 to obtain the value of each card before or after the card is dealt by the dealer 160.

The analysis system 130 can include one or more computing devices designed to calculate the odds and determine the results of each game based on information received from the card reader 120. The analysis system 130 communicates with the card reader and obtains data that includes the values of the cards being dealt by the dealer. The analysis system 130 can use the obtained data to generate output data that includes a score for each hand and calculated odds for each hand. The calculations of the scores and odds can be generated in real-time. The analysis system can receive input manually from the dealer or automatically from the card reader 120 when present.

For example, in a casino Baccarat game using actual playing cards, the analysis system 130 can be used by the casino to determine the odds for placing additional bets during a game play as described in this specification. The additional bets described in this specification are bets other than the traditional bets placed before the game play in Baccarat. In addition, the analysis system 130 could perform other functions, such as (1) determine whether to deal a third card; (2) determine scores for each hand; (3) determine odds (probabilities) for placing of the additional bets in real-time; (4) determine whether the additional bets should be received from the game participants; (5) determine the final scores for each hand of each participant; and (6) determine the winners. The functions performed for a Baccarat game are described further with respect to FIGS. 4, 5, 6*a*, 6*b* and 7 below.

For other card games, such as a casino Black Jack game using real cards, the analysis system 130 can also be used by the casino to determine the odds for placing additional bets during a game play as described in this specification. The additional bets described in this specification are bets other than the traditional bets placed before the game play or during the game play (insurance, double-up, split) in Black Jack. In addition, the analysis system 130 could perform other functions, such as (1) determine scores for each hand; (2) determine odds (probabilities) for placing of the additional bets in real-time; (3) determine whether the additional bets should be received from the game participants; (4) determine the final scores for each hand of each participant; and (5) determine the winners.

Based on these functions performed, the analysis system 130 can also send game information including participant specific information to the output system 140. Examples of game information can include an explanation of the rules of the game, possible options for each participant based on the currently dealt cards and example payouts for possible betting amounts. This information sent to the output device 140 is described further below.

The output system 140 can include a display device 142, such as a liquid crystal display (LCD) device or other similar devices for outputting visual cues to the participants and spectators. Example visual cues can include one or more of textual, graphical, video, etc. displays that convey the running scores and odds during the game play. Examples of the display device 142 include a computer monitor, a large screen television, and display unit associated with a computing device, such as a computer, a laptop and an end-user device. The output system can also include other output devices, such as a printer 144.

The visual cues displayed provide each participant with an opportunity to instantly obtain the scores and the odds during game play. The output system 440 can include a display system of one or more liquid crystal displays (LCD) of varying sizes. Such display system can allow all game participants and any spectators to view and obtain the scores and odds for each hand during the game play. In addition, the output system 140 can include individual display units provided for each game participant. The individual display units can be provided in addition to or instead of the display units of varying sizes.

When each game participant is provided with his/her own display unit, information customized for each participant can be presented on the display. For example, the participant's history of betting, scores, wins, losses, account balance, etc. can be presented on the personal display unit. The participant's information can be obtained by using a log-in procedure or using a key card, such as a frequent player account card that each participant can sign up for with the Casino. The display unit provided to each game participant can be used to keep track of game information such as trends and history of game results for each hand of each participant to allow each game participant to place bets on his hands and other participant's hands.

Figure 2:
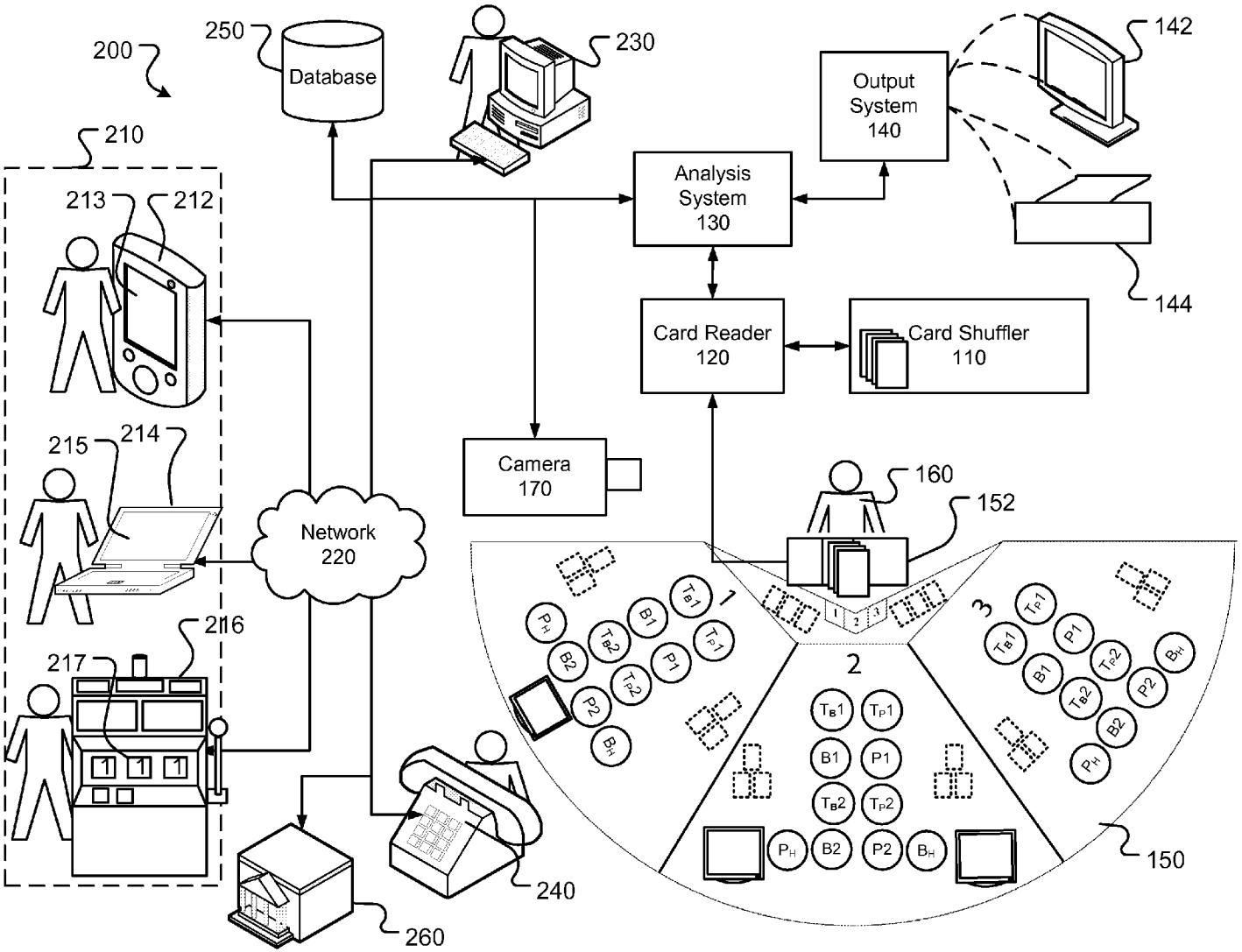
FIG. 2 shows an example system for allowing spectator participation.

The output system 140 includes on-site units and/or off-site units. For example, the displayed output data can be displayed to other viewers at remote locations. In such examples, the output system 140 includes remote units that are in communication with the system 100 over a network connection as shown in FIG. 2 below.

The table 150 includes a modified Baccarat table, such as those described with respect to FIGS. 3*a*, 4 and 5 below. However, the table 150 can have other designs that correspond to other card games, such blackjack. As described above, the table 150 can be modified to include an interface for the card reader. In some implementations, the card reader 420 can be integrated into the table along with the card shuffler 110.

Spectator Participation

In some implementations, people other than the game participants, such as the spectators to a card game, such as a Baccarat game can also place bets on any of the game participant's hands. FIG. 2 shows an example system 200 for allowing spectator participation. In addition to the components described in FIG. 1 above, the system 200 also includes a spectator system 210 for allowing persons other than those sitting at the table to participate in the game.

The spectator system 210 is in communication with the analysis system 130 to receive the output data generated by the analysis system 130. The spectator system 210 includes one or more end-user devices 212, 214, 216, etc. assigned to each spectator that wishes to participate. The end-user devices 212, 214, 216 can include a personal digital assistant (PDA), a laptop computer, a smart phone and other similar portable or handheld computing devices. The end-user devices 212, 214, 216 are in communication with the analysis system 130 over a network connection 220 to receive the output data that include the odds and results calculated by the analysis system 130. Each of the end-user devices 212, 214, 216 can include a display unit 213, 215, 217, etc. for displaying the output data received from the analysis system 230. In some implementations, the end-user devices can include other gaming devices such as slot-machines or video-game devices available on the casino floor.

The end-user devices 212, 214, 216 also include a mechanism for the spectators to place a bet on any of the game participants' hands. The mechanism for the spectators to place a bet can include a software application that provides a user interface to receive input from the spectators. For example, a user interface can include menus and other user selectable components, such as buttons, tabs, sliders, etc. for receiving input from the spectators. The participants are allowed to select any type of card game and particular card table connected to the system at the casino.

The end-user devices 212, 214, 216 can be in communication with the analysis system 130 over a communication link 220 that includes a wired or wireless connection. The communication link 220 can provide either unidirectional or bidirectional communications, and can be a part of a shared communication channel (e.g., a bus network). Examples of wired connections include a Universal Serial Bus (USB) connection, a FireWire connection, and other parallel or serial connections. Examples of wired connections include WiFi, Bluetooth, infrared, etc.

The system 200 can also include additional remote nodes. For example, an individual can interface with his/her computer 230 to access a website over a network (e.g., network 220) to log-in as an off-site participant or spectator to the table game at the casino. The individual can log-in using a standard network protocol login procedure, such as an HTTP connection. Also, an off-site casino 260 can be in communication with the table game by connecting to the analysis system 130 over the network 220. In addition, an individual can participate in the table game by calling a telephone number to access an interactive voice response system (IVR) or a live person to place bets.

The system 200 can also include a data repository 250 for storing game related information. The scores and odds can be stored in the data repository for archival purposes or for later data processing.

In some implementations, the system 200 can also include one or more audio-visual input devices or image capture devices 170, such as a camera (video or still) to capture live still and/or video data of a selected table game. The captured video data can include the value of each card dealt by the dealer to each hand of each participant.

The captured live still/to the end-user devices 212, 214, 216 such as slot machines within the casino. Any patrons at the casino can use the slot machines to place bets in the table game. The slot machines can be configured to receive the live video and/or still feed from any table game in the casino. The patron using the slot machine can select one or more table games to receive the live feed and place bets on any of the hands in the selected table game.

The slot machines can include any form of money accepting devices used in a casino such Coin or Bill Acceptors, Ticket-in-Ticket-out (TITO), magnetic and smart cards to receive a wager from the patrons. In addition, the live video feed can incorporate video recognition technology to identify the cards and the hand signal of the dealer "for no more bets," for example.

The existing slot machines within each casino can be retrofit to receive the video from the table games. This can be done without disturbing the table games as the casino.

The casino commission for the wagers placed from the slot machines can be calculated by the slot machines or the analysis system 130. The money settlements can be done through existing TITO systems available throughout the casino which are linked to their centralized Slot Accounting System.

Figure 3A:
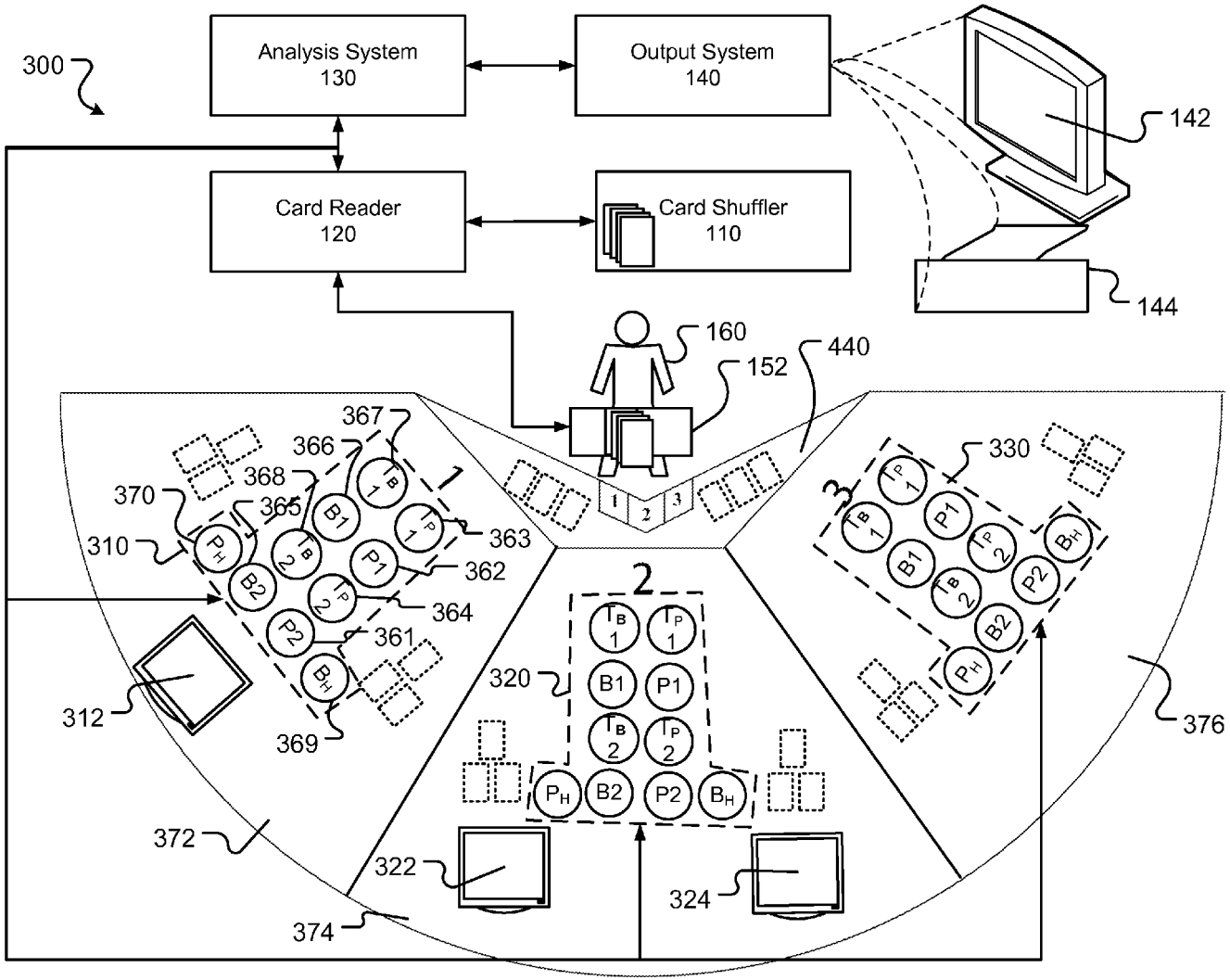
FIGS. 3*a*, 3*b*, 3*c*, 3*d*, 3*e* and 3*f* show an example system for receiving user input.
Figure 3B:
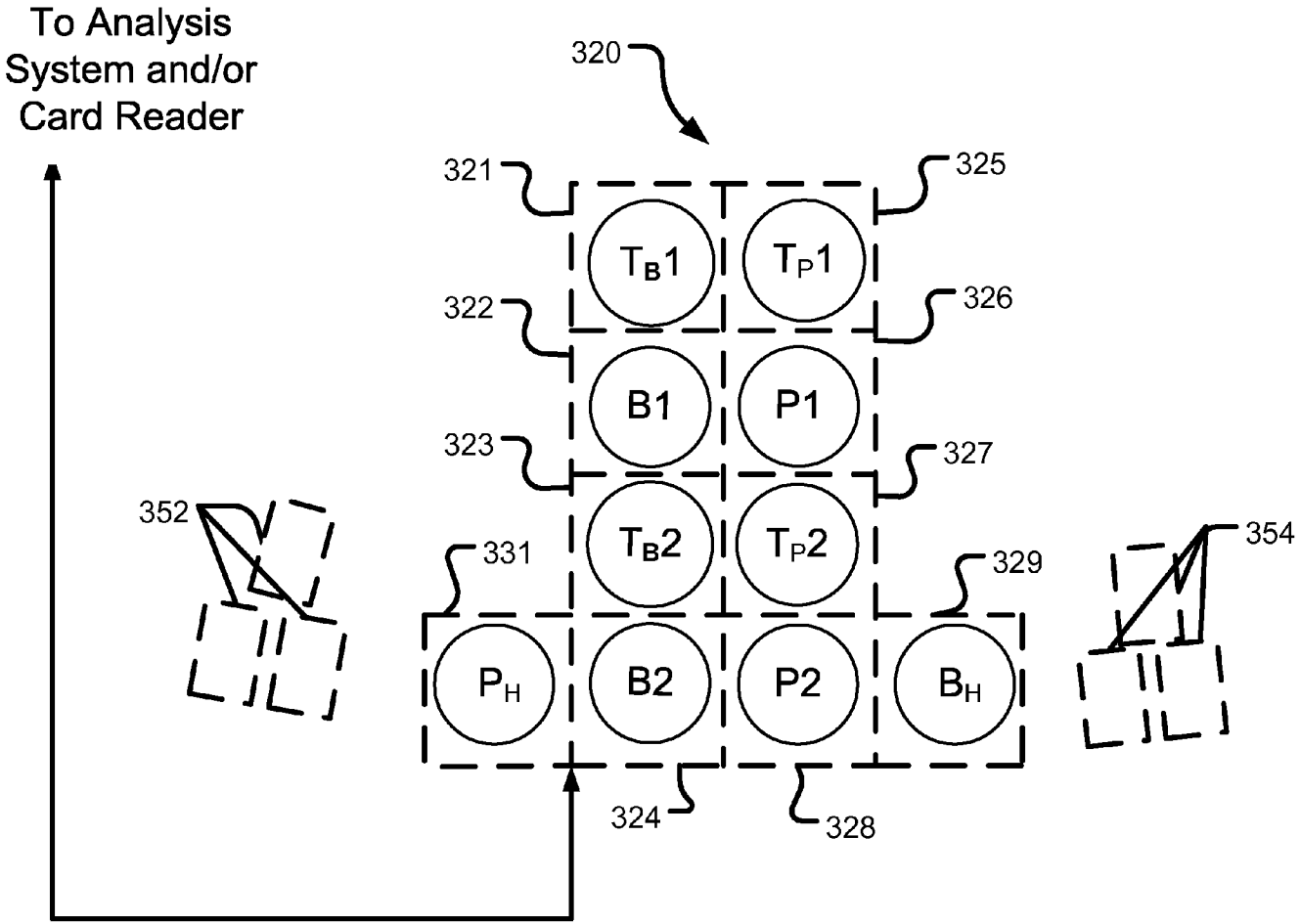

FIGS. 3*a* and 3*b* show an example system 300 to facilitate processing of user input during a card game as described in this specification. The systems 100 and 200 as described above can be modified to include additional components to provide additional technical solutions in processing user input. For example, the system 300 can include some or all of the features described with respect to FIGS. 100 and 200 above. An additional input sensor 310 can be provided for each space 372, 374 and 376 allocated to each participant. Each of the input sensors 310, 320, 330 can be incorporated with betting spaces (e.g., 361, 362, 363, 364, 365, 366 and 367, 368, 369 and 370) to automatically determine whether any of the participants have placed a bet on any of the betting spaces.

The input sensors 310, 320, 330 can include a pressure sensor, a touch sensor, an optical reader, a weight sensor, a microchip such as a[[n]] radio-frequency identification (RFID) sensor associated with betting chips or a combination thereof. FIG. 3*b* shows an example design of input sensor 320 for illustrative purposes. The input sensor 320 can include multiple delineated active areas that can be dynamically arranged and customized with respect to shape and size based on the application. For example, FIG. 3*b* shows the input sensor implemented as 10 distinct active areas 321, 322, 323,

324, 325, 326, 327, 328, 329 and 331 that correspond to each betting/participant space 372, 374 and 376 (see FIG. 3*a*). Each active area can detect via touch, pressure, etc. whether a bet has been placed and the amount of the bet.

For example, in the non-traditional Baccarat game described in this specification, when a participant places a bet on his Bank hand (B1) by placing chips on active area 322, the active area 322 senses the chips via touch, pressure, optical scan and sends a signal to an analysis system (e.g., analysis system 130). The signal from the active area 322 can include data that identify the type of chip placed and the amount based on touch, pressure optical scan or a combination thereof. Thus, the analysis system 130 can automatically determine the types of bets placed by the participant and the amount of his/her wager for each type of bet.

In addition, the output system 140 can include individual display units 312, 322 and/or 324 located at or near the table. For example, a single display unit 312 can be incorporated into the surface of the table to provide data associated with each participant's Player and/or Bank hand. The display unit 312 can be mounted on the surface of the table so that the display surface of the display unit is flush with the surface of the table. Once flush-mounted onto the surface of the table, the display unit 312 can be rotated or tilted so that the display surface is positioned at an angle with respect to the surface of the table. The display unit can be rotated or tilted to obtain any angle in the range between 90 and 180 degrees with respect to the surface of the table. The 180 degree angle represents the display surface of the display unit being flush with the surface of the table. The single display unit configuration is shown in FIG. 3*a* with respect to the participant 1's space 312 for illustrative purposes.

In some implementations, two display units 322 and 324 can be mounted on the table, one for each hand (e.g., Player and Bank hand in Baccarat) of each participant. By providing a display unit for each hand, the information can be further separated and thus assisting each participant to keep track of his/her hands. FIG. 3*a* shows the two display unit configuration with respect to participant 2's space 320. While, different participant spaces 372, 374 and 376 are shown with different display unit configurations, all participant spaces can be provided with the same display configurations (i.e., all with one display unit or all with two display units.) Alternatively, the different display configurations can be available for each participant space.

Further, the system 300 can include visual indicators 352 and 354 for each participant's space to provide a visual cue as to whether each participant should receive his/her own Player hand and/or Bank hand. Based on the above determination of the types of bets placed by the participant, the analysis system can send a signal to the visual indicators 352 and/or 354 to allow the participants and the dealer to know that the participants should receive his/her own Player hand and/or Bank hand. Visual indicator 354 can correspond to a participant's Player hand and the visual indicator 352 can correspond to the participant's Bank hand.

The visual indicators 352, 354 can include a simple light, such as an LED light that lights up when the corresponding hand should be dealt. When the participant places a bet in the active space 321 or 322 only, the visual indicator 352 lights up but not visual indicator 354. When the participant places a bet in the active space 325 or 326 only, the visual indicator 354 lights up but not visual indicator 352. When the participant places a bet on both active spaces (321 or 322) and (325 or 326), both visual indicators 352 and 354 light up.

The visual indicators 354 and 352 can include a simple light with no particular shape. Also, the visual indicators 354 and 352 can include any appropriate terms associated with each hand of cards. For example, in a Baccarat game, the visual indicators can include terms "Player Hand" (or "Player") and "Bank Hand" (or "Bank") respectively that light up. Other visual indications can be implemented, such as blinking light, an illustration, a photograph, etc.

While the active areas 321, 322, 323, 324, 325, 326, 327, 328, 329 and 331 are shown as circular shapes, other shapes can be implemented. For example, rectangles, triangles, stars, etc. can be implemented. Similarly, the visual indicators, such as visual indicators 354 and 352 can be implemented in other shapes including rectangles, triangles, stars, etc.

Figure 3C:
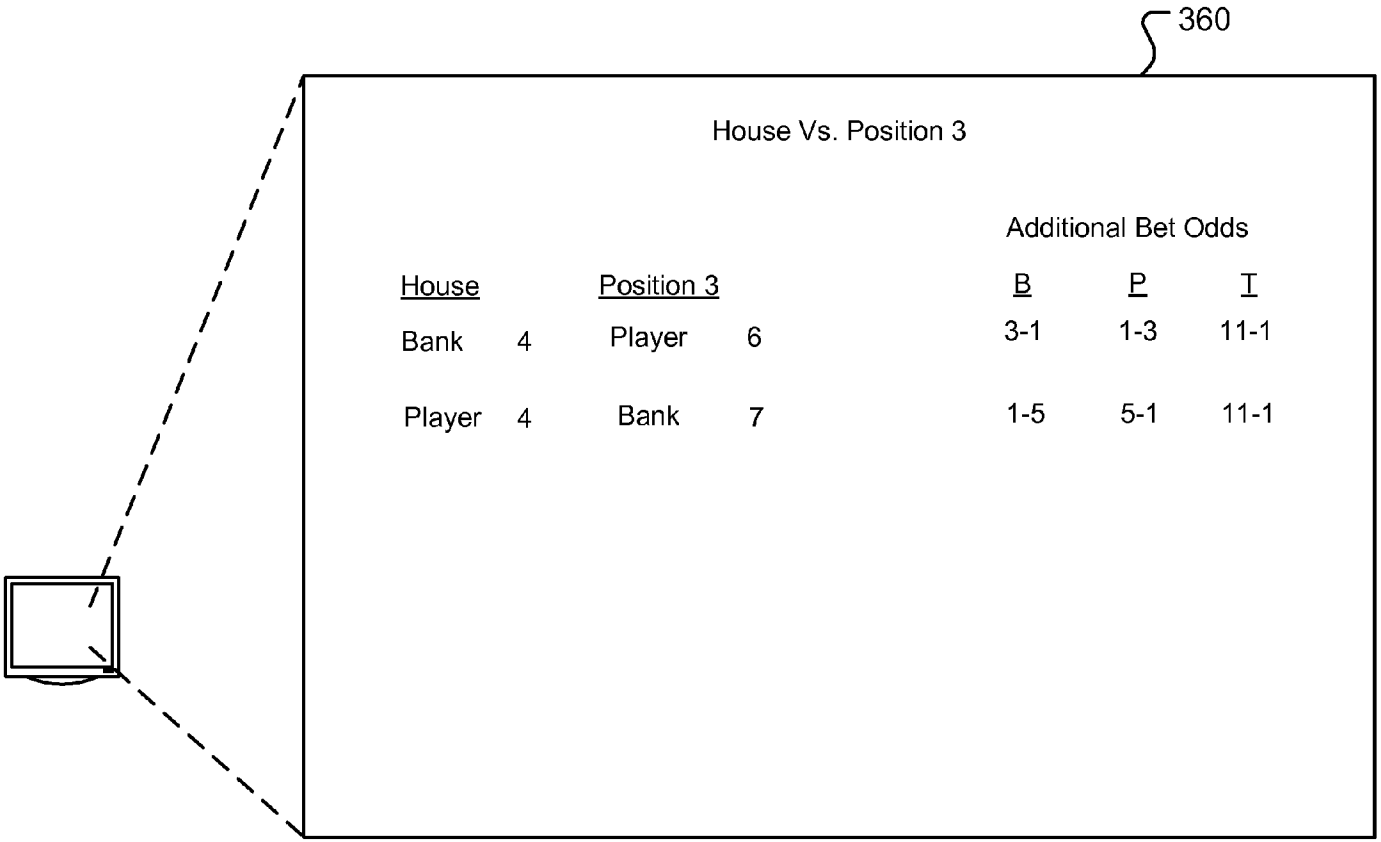

FIG. 3*c* shows example information 360 displayed on the output device (e.g., display device 312). The analysis system 130 can output data to the display device (e.g., display device 312) to display real-time status and information for each participant throughout the game play. This information 360 is displayed on the respective individual display units when physical casino chips are used to place bets. For example, the information 360 displayed can include the real-time score for each participant's hand(s) and the house's hands. For the Baccarat example, after the two cards are dealt, two card scores can be provided. Then after the third card is dealt, the three card score can be displayed. In some implementations, the information can be used to inform each participant of the rules of the game including options available to each participant. For example, each participant can be informed whether a third card can be obtained. In addition, each participant can be informed whether an additional bet is available. If an additional bet is available, the dynamically calculated odds for placing additional bets on the participant's own hands can be displayed. The information 360 shows the above described information for participant 3 for example.

Figure 3D:
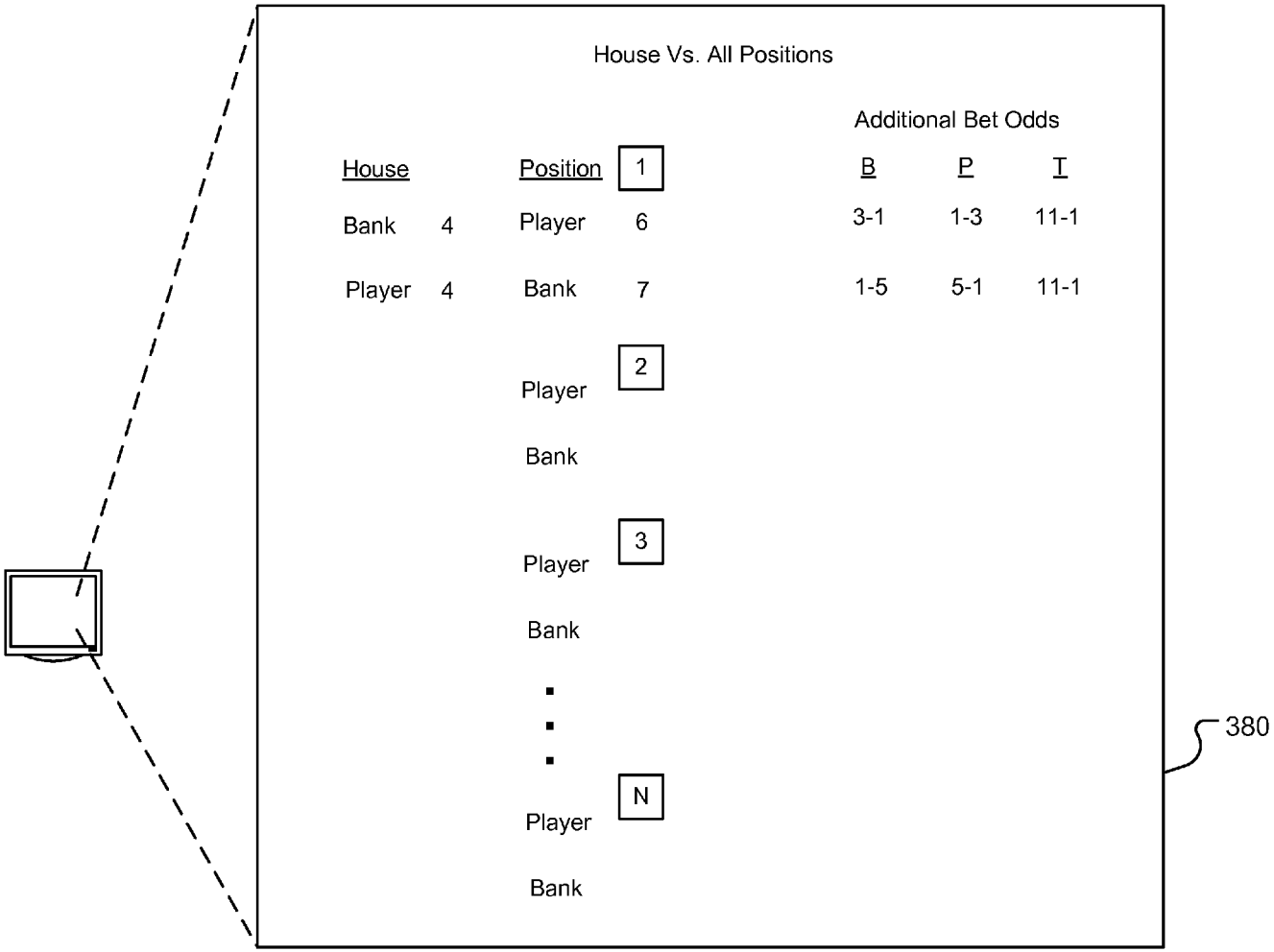

FIG. 3*d* shows example information 382 displayed on a display device that includes information on all positions. This information 382 can be displayed on a display unit viewable by all participants. In this manner all participants can easily view the scores for all hands of all participants. Similar to FIG. 3*c*, the system allows each participant to use physical chips to place bets on the participant's own hands. Also, the odds for additional bets can be displayed for all positions.

The display unit can include a touch-screen interface to allow the participant to provide input in response to the displayed information 380 that includes interactive information. For example, using the touch-screen, the participant can place bets on the participant's own hands or other participants' hands or both using electronic betting means.

Figure 3E:
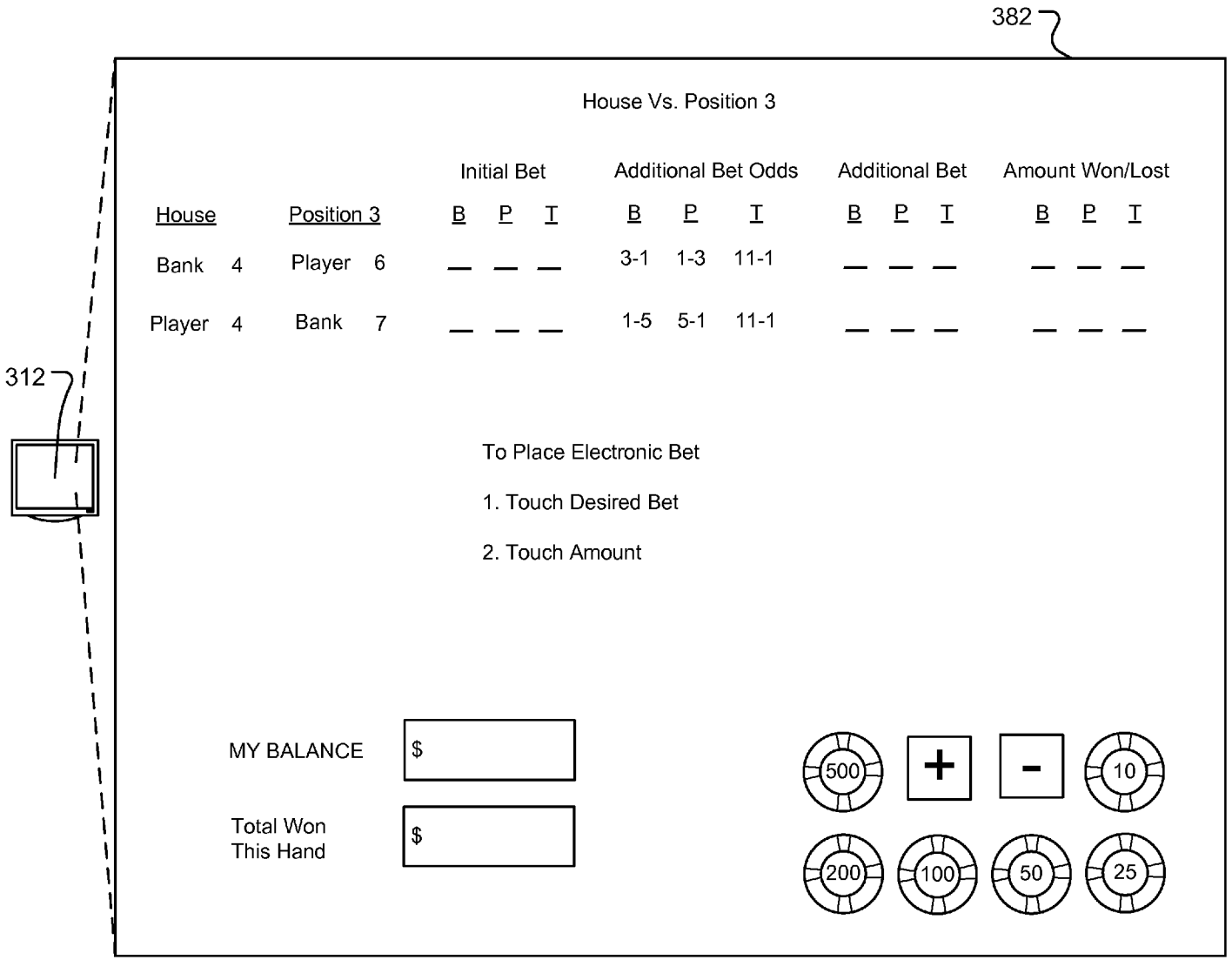

FIG. 3*e* shows example betting information 382 displayed on a display unit (e.g., display 312) that allows each participant to place various electronic bets on the participant's own hands and/or other participant's hands. The betting information 382 includes total scores for each hand of the house and the respective participant. Information 382 shows the score for the House and Position 3, for example. In addition, the initial bet amounts for each type of bets, such as House's Player hand vs. Participant's Bank hand (B), House's Bank hand vs. Participant's Player hand (P) and Tie (T) bets can be displayed. Also the odds for additional B, P and T bets can be displayed. Additional bet amounts for the additional B, P, T bets can be displayed. In addition, the amount won/lost for the B, P, and T bets can be displayed.

To place initial and additional bets, the participant can touch the desired bet. Then the bet amount for the bets can be inputted by touching the appropriate money amount (500, 200, 100, 50, 25 and 10) and then adding or subtracting the selected money amount by touching the add (+) or subtract (–) touch-buttons. The displayed information 382 can include the balance for the respective participant (My Balance) and the total won for each hand.

Figure 3F:
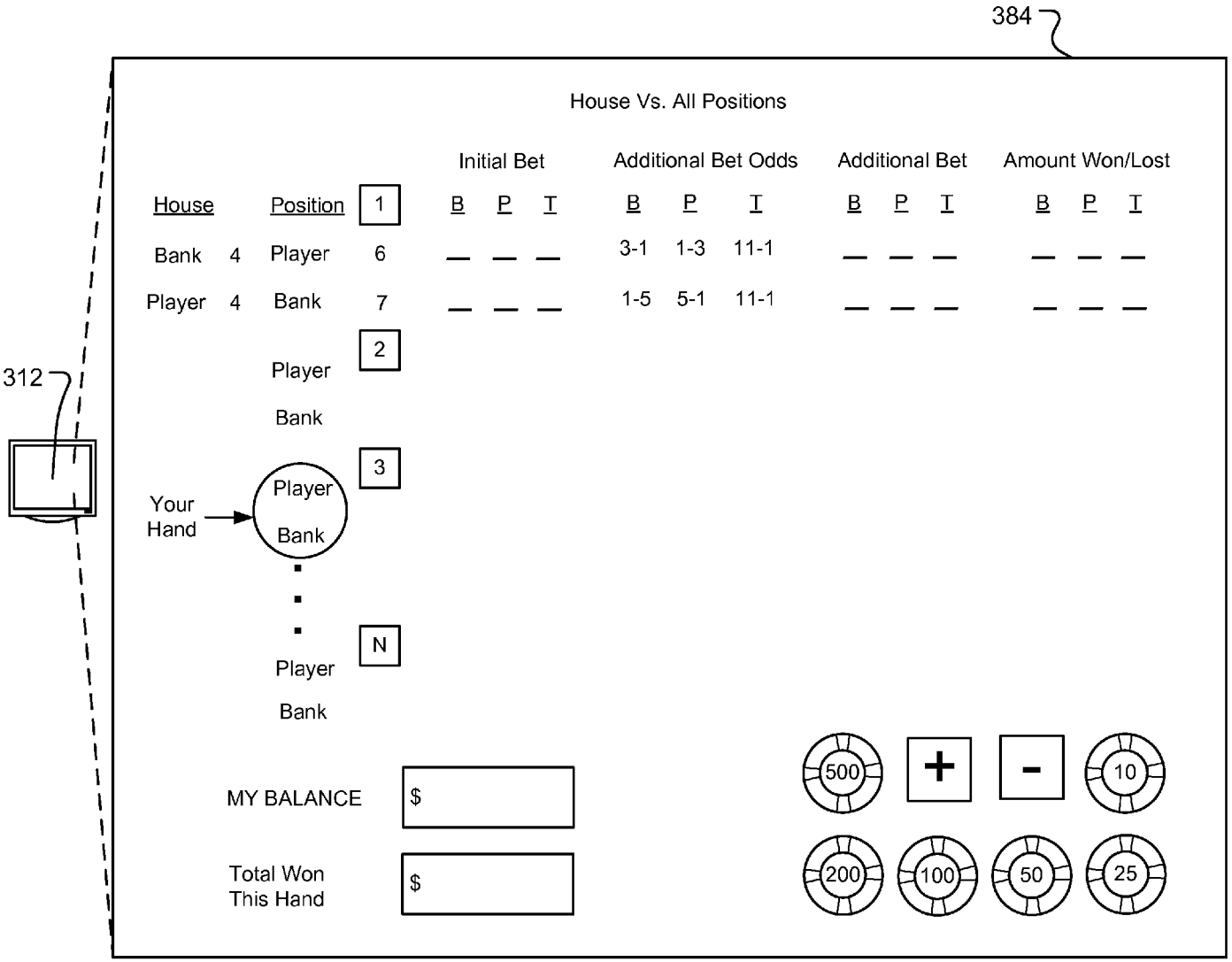

FIG. 3*f* shows example information 384 displayed to enable each participant to place bets on other participant's hands in addition to his own hands. The information 384 includes the same information as information 382 but provides the information for all participants. This information 384 can be displayed on individual display units to allow each participant to place electronic bets on his own hands and other participant's hands.

In all of the information 360, 380, 382 and 384, history of winning and losing for each hand of each participant can be tracked displayed on the display unit to allow the participant to analyze the tracked history and make future bets based on the tracked history.

The systems 100, 200 and 300 as described above can be implemented to facilitate game play in various card games, such as Blackjack and Baccarat.

For example, the systems 100, 200 and 300 can be implemented in a non-traditional version of Baccarat as described that allows each game participant the opportunity to play one hand against the House or to play two hands against the House's two hands. In traditional Baccarat, only two hands are dealt, one for the Player position and one for the Bank position. In addition, in traditional Baccarat table games, some House rules allow game participants to touch the cards and in other cases, house rules prohibit the touching of cards by game participants. In games in which participants are allowed to touch the cards, the game participant who places the highest bet on Bank generally has first option to look at the Bank hand, and the game participant who places the highest bet on Player generally has first option to look at the Player's hand. Baccarat players, especially high rollers, may cherish the privilege of looking at the initial cards and draws, and often times employ elaborate rituals while doing so.

Further, commercially available casino table versions of the game of Baccarat generally provide game participants a choice of three standard bets per hand: BANK, PLAYER and/or TIE. And while other side bets are sometimes accepted, both standard bets and side bets are accepted by casinos only prior to the beginning of each hand.

In addition, in the non-traditional version of Baccarat described in this specification, each game participant is able to place additional bets on each of their hands and each of other game participants' hands with the odds associated with each bet tracked by a system described in this specification. Additional bets, if allowed by the House rules, may only be placed before the $3^{rd}$ card is dealt to Player hand and/or before a $3^{rd}$ card is dealt to Bank hand. In contrast to bets that are required to be placed before the beginning of a hand, additional bets are based on changing odds of winning as the game progresses.

Baccarat is a simple gambling card game with only three possible results (excluding approved side bets): (1) Player, (2) Bank and (3) TIE. The term Player does not refer to a game participant, and the term Bank does not refer to the house. Player, Bank and TIE are merely names of three betting options from which a game participant can choose.

Baccarat, as played on a table in a casino, is generally played with 8 decks of cards dealt from a container known as a shoe. The shoe facilitates efficient dealing while decreasing the chance of cards being prematurely exposed by the dealer. Baccarat, in its electronic form, as played on-line or by machine in a casino, may use electronic decks of cards and shoes in which shuffles may not occur until the end of the shoe as in table games using real cards. In situations where the participants can gain an advantage by counting cards, the casino may reshuffle or use a new deck prior to dealing a new hand. For example, when additional bets are allowed, such reshuffle may be used. For both table games and electronic games, the cards can be reshuffled after each hand is played as described above.

Scoring in Baccarat involves the assignment of points corresponding to the face value of each card. The suit and color does not matter in determining the value of each card. Aces are worth 1. Each numbered card less than ten is worth its face value. Tens and face cards are worth 0. Further, the score of a hand is determined by the right digit of the total value of the cards. For example, if the cards dealt are an 8 and a 7 (of any suit or color), the total value is 15 but the score for the hand would be 5. If the cards dealt are an 8, 7 and a 6, the total value is 21 but the score would be 1. The scores always range from 0 to 9, and it is impossible to bust as in the game of blackjack. The winning hand is determined by identifying the hand with a score closest to 9 at the end. Matching scores at the end are considered a TIE. In case of a TIE, bets on TIE win and bets on the Bank and Player positions are returned.

Baccarat is a game that tends to attract high stakes because (with the exception of the TIE bet) the game provides extremely close odds, as can be seen in Table 1 below.

TABLE 1

Traditional Baccarat Bets

| | | Calculating Odds | Net Odds |
|---|---|---|---|
| Bet on Bank (Pays 1-1 less 5% commission) | Winning Hand | 50.68% × 0.95 | 48.15% |
| 1-1 is verbally spoken as 1 to 1 | Losing Hand | 49.32% × 1.00 | 49.32% |
| | House Edge | | 1.17% |
| Bet on Player (Pays 1-1 with no commission) | Winning Hand | 49.32% × 1.00 | 49.32% |
| | Losing Hand | 50.68% × 1.00 | 50.68% |
| | House Edge | | 1.36% |
| Bet on TIE (Pays 8-1 with no commission) | Winning Hand | 9.54% × 8.00 | 76.32% |
| 8-1 is oftentimes described as 9 for 1 | Losing Hand | 90.46% × 1.00 | 90.46% |
| | House Edge | | 14.14% |

Traditionally, the bets on BANK, PLAYER and TIE are placed by game participants prior to the beginning of each hand. In some instances, various supplemental bets may be allowed by some casinos, but in all cases of table game and virtually in all cases of on-line gaming, these early bets are placed when the odds of winning or losing, as described in Table 1, are static since no cards have been dealt yet. Additional bets, as described in this specification, are based on the changing odds of winning as the hand progresses. The opportunity to place additional bets on BANK, PLAYER and TIE based on changing odds can make the game of Baccarat far more challenging and fun for the game participants, while simultaneously producing additional play and revenues for casinos. These additional bets could be placed without respect to (1) whether the game participant had placed a bet prior to the beginning of the hand and (2) without respect to whether a game participant's first bet was on BANK or PLAYER and/or TIE and/or any side bet allowed.

Similarly in Blackjack, each game participant is able to place additional bets on hands of other participants and the house during the game play. In addition, the game participants can place additional bets on dynamic odds of winning as the game play advances.

Placing of Bets

As described above, in conventional Baccarat, while practice varies depending upon House rules, each game participant is normally allowed to place a bet on: (1) Tie and/or (2) Bank or Player (but not Bank and Player). The techniques and systems described in this specification provide each participant with the opportunity to obtain his/her own Player and Bank hands, and thus participants are provided with different betting opportunities. In particular, each game participant can be allowed (but not required) to place a bet on: (1) Bank and/or (2) Player and/or (3) Tie. The Tie bet can include a tie between each participant's Player hand and House's Bank hand, and a tie between each participant's Bank hand and House's Player hand. The system allows each participant to place bets on his own hands and other participant's hands.

Further, when additional bets are implemented in addition to providing each participant with his/her hand(s), the House is provided with the option of requiring a bet on TIE at traditional odds as a condition of a game participant being allowed to place an additional bet on TIE at additional bet odds offered by the House (e.g., a casino.) The ratio of how much money can be wagered by the game participant on additional bet TIES can be determined by the casino. For example, the ratio can include 1-1, 1-2, 2-1, etc.

Number of Hands Dealt

As described above, in traditional Baccarat only two hands are dealt at the table, one for the Player position and one for the Bank position. All participants bet on the same two hands, and each participant is not able to obtain his own hands.

The techniques and systems described in this specification provide each game participant with the opportunity to obtain his/her own Player and Bank hands. For example, a participant who places a bet on Bank or Bank and Tie is dealt his or her own Bank hand. A participant who places a bet on Player or Player and Tie is dealt his or her own Player hand. A participant who places a bet on Bank and Player and/or Tie is dealt his or her own Bank hand and his or her own Player hand.

Table Layout

Figure 4:
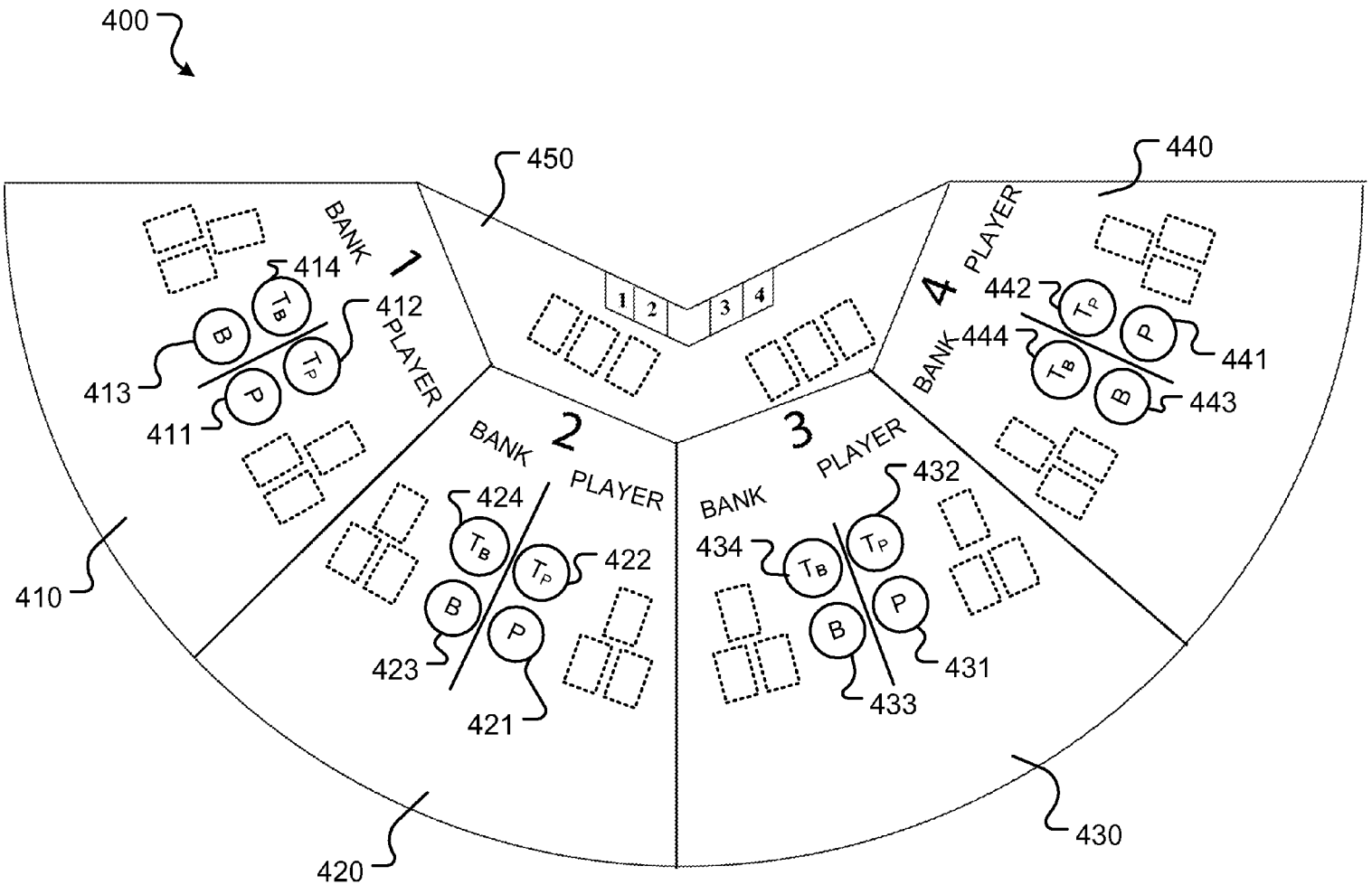
FIG. 4 shows an example Baccarat table for implementing multiple hands for each game participant.

FIG. 4 shows an example table layout 400 for providing each game participant to receive his own Player and Bank hands. The table layout 400 represents a mini-baccarat table depicting enough surface space for four game participants 410, 420, 430 and 440 in addition to space for the house 450. However, depending upon table size, more or less than four game participants could be accommodated.

The table layout 400 is designed to provide each game participant with more space on a surface of the table than in a traditional baccarat game. The table layout 400 includes enough surface space for each participant to place bets and to receive and view up to two hands (e.g., participant's own player and bank hands). In addition, the space 410, 420, 430, 440 provided to each participant in the table layout 400 includes each enough surface space for a dealer to deal up to two hands to each participant without intermingling the cards dealt to a participant's first hand with the cards dealt to that game participant's second hand. Further, the space 410, 420, 430, 440 provided to each participant includes enough space for the dealer to deal up to two hands for each participant without intermingling the cards dealt to one participant with cards dealt to another participant.

The table layout 400 includes a betting space 411, 421, 431, 441 for each participant's Player hand versus the House's Bank hand. The table layout 400 also includes a betting space 413, 423, 433, 443 for each participant's Bank Hand versus the House's Player hand. In addition, the table layout 400 includes a separate betting space for a TIE bet on either hand. The betting spaces 412, 422, 432 and 442 represent a TIE bet betting space for each participant's Player hand (versus the House's Bank hand). The betting spaces 414, 424, 434 and 444 represent a TIE bet betting space for each participant's Bank hand (versus the House's Player Hand).

Figure 5:
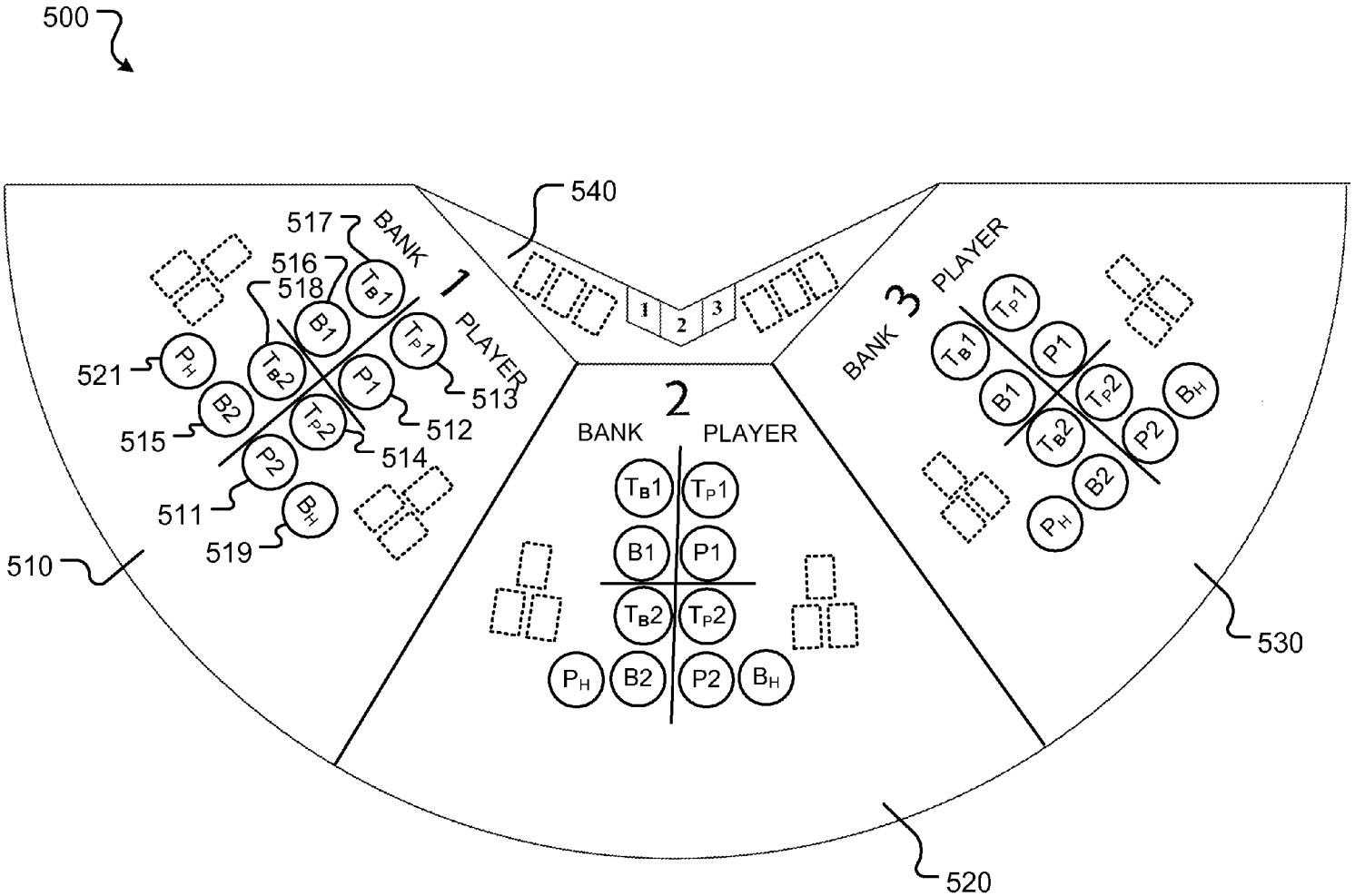
FIG. 5 shows an example Baccarat table for implementing multiple hands for each game participant and allowing additional bets.

FIG. 5 shows an example table layout 500 for increasing the number of hands dealt and allowing additional bet opportunities. In addition to the features described with respect to FIG. 4 above, the table layout 500 includes betting spaces for additional bets for each participant. For illustrative purposes, the table layout 500 shows enough space on a surface of a table for three participants 510, 520 and 530 in addition to the House 540. However, the table layout 500 can be modified to accommodate more than three participants.

For example, space 510 provided for participant 1 includes an initial betting space 512 for participant 1's Player hand versus the House's Bank hand. The space 510 provided for participant 1 also includes an initial betting space 516 for participant 1's Bank hand versus the House's Player hand. Also, betting spaces 511 and 515 for additional bets are provided for betting on participant 1's Player and Bank hands respectively. Two more additional betting spaces 519 and 521 for placing cross bets on House's Bank and Player hands respectively are also shown. During game play, a participant may start with bets placed on his own Player hand. Then, as part of the additional bets allowed, based on casino rules, the participant place a cross-bet on the House's Bank hand. This maybe desirable when the participant realizes during game play that the House's Bank hand is more likely to win. A similar cross bet on the House's Player hand can be placed.

The space 510 for participant 1 also includes betting spaces for TIE bets including initial TIE bets and additional bet TIE bets. The initial TIE bet spaces include an initial TIE bet space 513 for participant 1's Player hand vs. House's Bank hand and an initial TIE bet space 517 for participant 1's Bank hand vs. House's Player hand. In addition, the space 510 includes additional bet TIE bet spaces including an additional bet TIE bet space 514 for participant 1's Player hand vs. House's Bank hand and an additional bet TIE bet space 518 for participant 1's Bank hand vs. House's Player hand.

Similar betting spaces are provided for other participants. Thus, the spaces 520 and 530 provided for participants 2 and 3 respectively also include the initial and additional bet spaces for each participant's Player hand vs. House's Bank hand, each participant's Bank hand vs. House's Player hand, and Tie bets for both Player and Bank hands of each participant as described above.

Determination of Winning Hand

Independent of the number of hands dealt to each participant, the winning hand is determined using the standard rules of Baccarat as follows:

A. Each game participant's Player hand versus House's Bank hand.

B. Each game participant's Bank hand versus House's Player hand.

C. Two options on TIE bet:

(1) TIE on each game participants Player hand versus House's Bank hand.

(2) TIE on each game participant's Bank hand versus House's Player hand.

Deal Begins

Figure 6A:
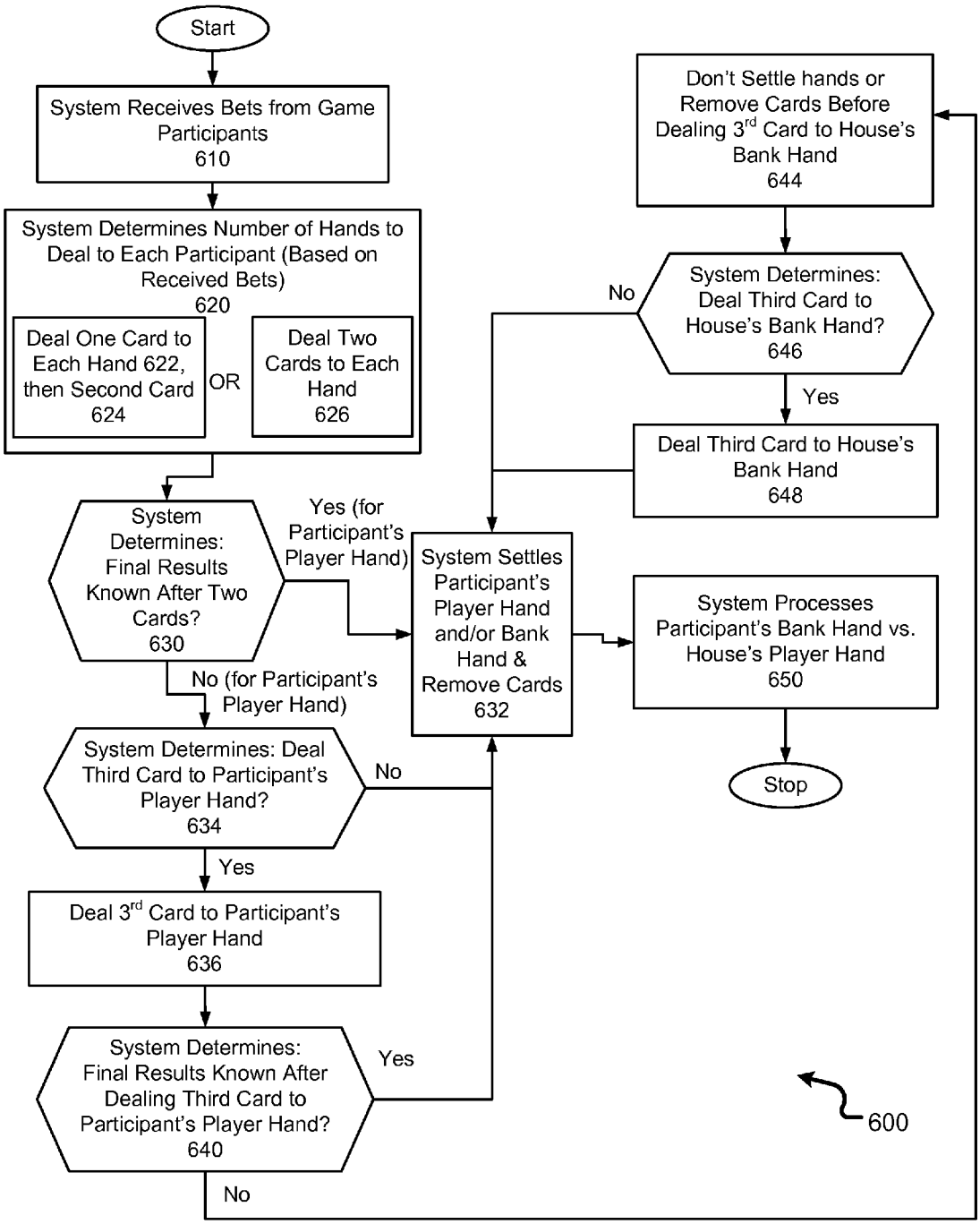
FIGS. 6*a* and 6*b* show an example process for implementing multiple hands for each game participant (with and without additional bets).
Figure 6B:
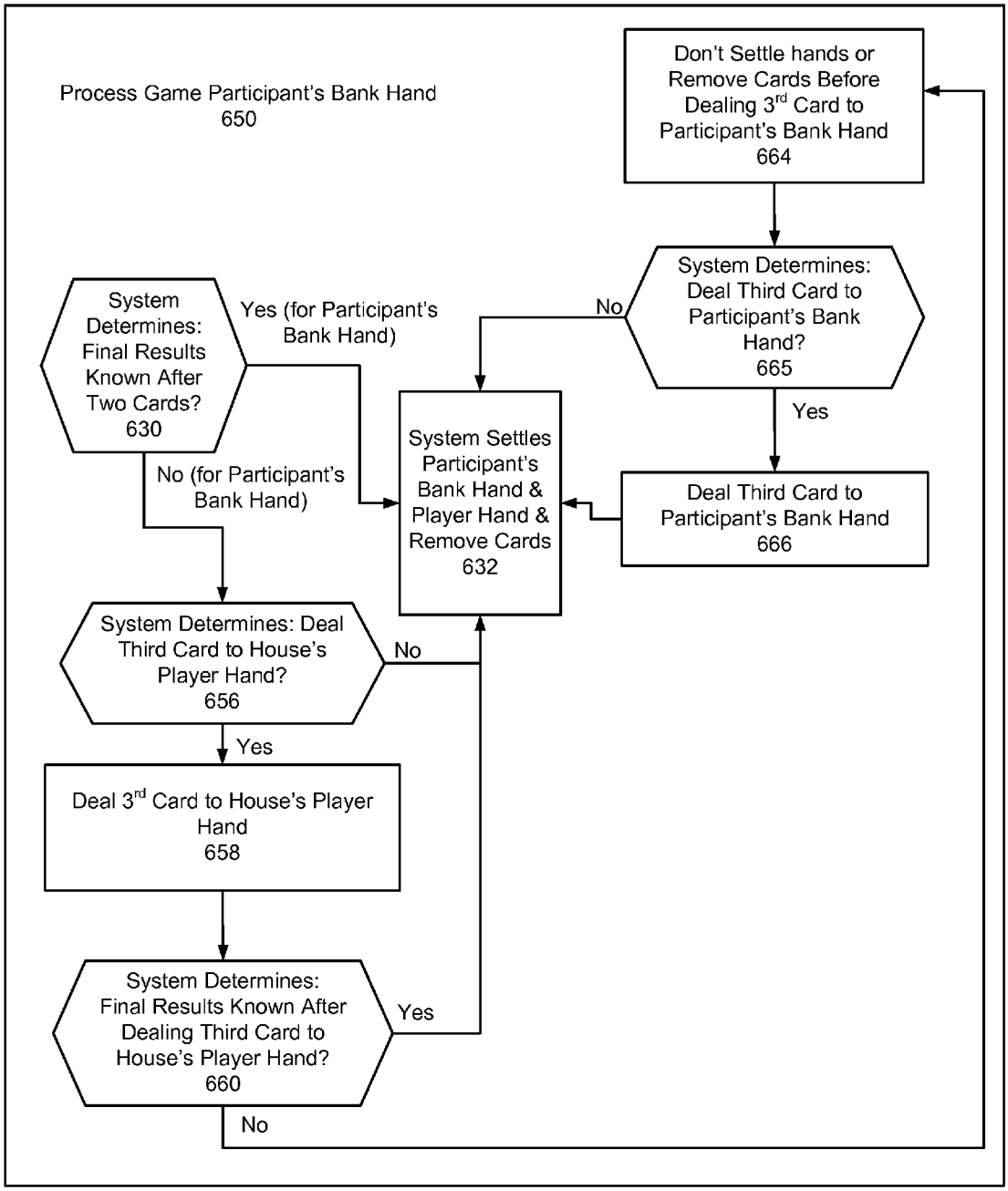

FIGS. 6*a* and 6*b* show an example process 600 for providing each game participant with an option to obtain his/her own Player and Bank hands. A system (e.g., system 100, 200, 300 as described above) receives an initial bet from each game participant (610). Each game participant can place a bet on his/her own Player, Bank and/or Tie positions (e.g., positions 411, 413, 412, 414.) In response to the received bets, the system determines a number of hands (e.g., a player hand and/or a bank hand) to deal to each participant based on the received initial bet. The system can send a signal to the dealer to indicate the determined number of hands (and types of hands, such as player or bank) to deal to each participant. This signal can be sent to the visual indicators 352 and 354 (see FIG. 3*b*) located at each participant's space to provide a visual cue as to whether each participant should receive his/her own Player hand and/or Bank hand, for example. The signal can be sent to a display unit provided to the dealer to indicate the number of hands to be dealt to each participant and the types of hands (player hand and/or bank hand). Based on the received signal, the dealer deals the first two cards (620) to each of the game participants hand or hands and the House's hands. The order of the deal can proceed in a counter clockwise fashion around the table. Based on the received bet for each game participant, an initial card is dealt to each participant beginning with the first game participant to the left of the dealer, for example (622). For example, if the first game participant places a bet on just Player and/or Tie, then that game participant receives one Player hand, and the first card dealt is the first card of that game participant's Player hand. If the first game participant to 16.

The above described initial card example applies to each game participant in the order of the deal (e.g., counter clockwise order) and to the House hands as applicable. The House receives both a Player hand and a Bank hand anytime game participants collectively place bets on both Player and Bank.

Next, a second card is dealt (624) to each game participant and the House. The procedure described above for dealing the first card is followed for the second card. For example, those game participants that place a bet on both of his/her Player and Bank positions receive two second cards, one for each hand.

Alternate Process of Dealing the First Two Cards of Each Hand (to be Determined by House Rules)

In some implementations, each of the game participants and the House are dealt both of the initial card and the second card for each hand before other participants or the House receives their cards (626). For example, if the first game participant to the left of the dealer is to receive both a Player and a Bank hand, the first two cards received by the game participant is dealt to the first game participant's Player hand and the second two cards are dealt to the first game participant's Bank hand. After the first game participant has received all of his/her cards for all of his/her hands, each of the other participants receives his/her cards using the same system process of distribution.

At the option of the House, one or more of an electronic dealing machine, an optical card reader and a shuffle machine can be used to assist distribution of the initial two cards for each game participant as described with respect to FIGS. 1, 2, 3*a*, 3*b* and 3*c* above.

Two-Card Score Results on House's Bank Hand Vs. Game Participant's Player Hand or House's Player Hand Vs. Game Participant's Bank are Known after Second Card After the two cards have been dealt to a Player hand and a Bank hand for each game participant and the House, a determination is made on whether a final result is known (i.e., which hand won) (630). Such determination can be made manually by the dealer or automatically by the system that analyzes the odds and scores (e.g., systems 100, 200 and 300 shown above with respect to FIGS. 1, 2, 3*a*, 3*b*, 3*c* and 3*d*.) For example, a two-card score is calculated for the Player hand and the Bank hand of each participant and the House's Player hand and Bank hand. The calculated two-card scores for the participants' Player hands and Bank hands can be compared with the two-card score for the House's Bank hand and Player hand to determine the winning hand.

The final results can be known after the first two cards are dealt for at least the following example cases:

(1) House's Player hand and/or game participant's Bank hand starting total is 8 or 9.

(2) House's Bank hand and/or game participant's Player hand starting total is 8 or 9.

(3) House's two-card Player hand total is either 6 or 7 and the game participant's two card Bank hand total is 6 or 7.

(4) House's two card Bank hand total is either 6 or 7 and game participant's two-card Player hand total is 6 or 7.

If the game participant wins, he or she is paid on the spot at the approved and published payoff for the particular bet. If the game participant loses, his bet is collected at that time by the House, and the game participant's losing hand is removed from the table. In either case, win or lose participants hands are removed from the table.

The determination of the final result is made on a game participant by game participant basis. In other words, in a game in which there are five participants, and the final results are known after the first two cards were dealt for three of the five game participants, only those three game participants will have their cards removed. In addition, only those three game participants' bets are settled at that time.

For example, if the House's Bank hand's two card total is 6 and three of the game participants have a two card total of 7, 8 and 9 respectively, the hands of the three game participants are over and are removed. If two other game participants had a two card total of 0-5, play continues for those game participants under the standard rules of Baccarat.

In addition, side bets may be allowed depending on House rules. Any side bets allowed by the House rules can also be received along with the initial bet at 610 above. Results of the side bets that can be determined after two cards have been dealt may be settled at that time. However, settlement of the side bets does not automatically result in the cards being removed from the table because the final results of the non-side bets may still be pending.

Deal Continues

When the final result is NOT known after the first two cards are dealt, the system (or the dealer) determines whether to deal a third card to game participants' Player hands (634). Each participant's Player hand that is eligible to receive a third card is dealt the third card (636). All others do not receive a third card and their Player hands are settled as above (632). All game participants with a Player hand face off against the Bank hand dealt to the House and will draw a third card or stand based on the traditional rules of Baccarat. The first game participant to the left of the House placing a bet on his/her Player hand acts first (e.g., whether to receive a third card), followed in order by each of the other game participants placing a bet on his/her Player hand.

Final Results on House's Bank Hand Vs. Game Participant's Player Hand are Known after Third Card Dealt to Game Participants' Player Hand The system (or dealer) determines whether the final result can be obtained after dealing a third card to those participants' Player hands eligible to receive the third card (640). For example, the system can calculate a three-card score for those participants' Player hands that receive a third card. Based on the calculated three-card score, the system can determine the final result. When the final result is known only after a third card has been dealt to a game participant's Player hand, the game participant's hand is removed from the table and settled at that time as described above (632). If the game participant wins, he or she is paid on the spot at the approved and published payoff for the particular bet. If the game participant loses, his/her bet is collected at that time by the House and the game participant's losing hand is removed from the table. The same procedure also applies to approved side bets.

A third card can be dealt to participants' player hands but not the House's Bank hand for the following cases:

(1) Game participant receives a third card on a two card total of 0-5 and the House's Bank hand is not entitled to receive a third card (two card total of 7).

(2) House's Bank hand's starting total is 3-6, and the game participant draws a third card to his or her Player hand that DOES NOT entitle House's Bank hand to draw a third card.

Any additional bets or other side bets allowed by House rules that have been determined after the third card has been dealt the game participant's Player hand are also settled prior to the cards being removed from the table. Additional bets, if allowed by the House rules, may only be placed before the 3rd card is dealt to Player hand and/or before a 3rd card is dealt to Bank hand. The system allows each participant to place additional bets on his own hands and/or other participant's hands.

Results on House's Bank Hand Vs. Game Participant's Player Hand are not Known Until House's Bank Hand Receives a Third Card.

When the final result cannot be determined until after the House's Bank hand receives a 3rd card, the game participant's Player hand is not removed from the table and the bet is not settled until after a third card is dealt to the House's Bank hand (644). The system determines whether to deal a third card to the House's Bank hand (646). The third card can be dealt to House's Bank hand in the scenarios described below.

Examples of scenarios where the House receives a third card include the following:

(1) Game participant's Player hand stands on two card total of 6 or 7 and House's Bank hand's starting total is 0-5.

(2) Game participant draws to a starting Player total of 0-5, and House's Bank hand totals 0-2 and is entitled to draw a third card.

(3) House's Bank hand's starting total is 3-6, and the game participant draws a third card to his or her Player hand that ENTITLES the House's Bank hand to draw a third card.

Based on above scenarios, a third card is dealt to the House's Bank hand (648). Then the final results are determined and the Participants' Player hands are settled as described above (632). For example, the system can calculate a three-card score for the House's bank hand. The three-card score for the House's bank hand can be compared with the three-card scores of participants' Player hands to determine the final result.

Play Now Moves to House's Player Hand Versus Game Participant's Bank Hands

The process 600 moves on to process participants' Bank hand vs. House's Player hand (650).

Results on House's Player Hand Vs. Game Participant's Bank Hand are Known after Second Card As described above, the system (e.g., 100, 200 and 300) or the dealer (e.g., 160) determines whether the final result can be determined after the first two cards are dealt, but this time with respect to processing participants' Bank hands instead of Player hands (630). For multi-participant, multi-hand games, the dealer can deal two cards at a time to each Bank hand to speed up the process. However, the two cards can be dealt in an alternate fashion, one to each participant, as desired. For example, as described above, the system can calculate a two-card score for the House's player hand, and the calculated two-card score can be processed to determine whether the final result can be determined. When the final result is known after the first two cards are dealt as described above, the game participant's Bank hand is removed from the table and settled at that time (632). If the game participant wins, he or she is paid on the spot at the traditional payoff. If the game participant loses his bet on Bank and/or Tie, his losing bet is collected on the spot by the House. Examples of the above described results (House's Player hand vs. a game participant's Bank hand) being known after the second card include the following:

(1) Either game participant's Bank and/or House's Player starting total is 8 or 9.

(2) The House's Player hand's two card total is either 6 or 7 and the game participant's Bank hand's two card total is 6 or 7.

As described above, the determination of these results is made on a game participant by game participant basis. For example, when there are five participants in a game, and the final results are known after the first two cards are dealt for three of the five game participants, only those three game participants would have their cards removed. In addition, only those 3 game participants' bets are settled at that time. However, the other two game participants continue to play as follows.

Deal Continues

Final result may not be known after the first two cards are dealt for all the game participants.

Results on House's Player Hand Vs. Game Participant(s) Bank Hand are Known after Third Card Dealt to House's Player Hand The system or dealer determines whether to deal a third card to House's Player hand (656). The third card is dealt to House's Player hand based on standard rules of Baccarat (658). For those participants not eligible or not decided to receive a third card, their Bank hands are settled as described above (632). The system also determines whether the final results are known after dealing the third card to House's Player hand only (660). For example, the system can calculate a three-card score for the House's Player hand. The calculated three-card score for the House's Player hand can be compared with the two-card score for the participants' Bank hands to determine whether the final result can be determined. When the final results are known after a third card has been dealt to the House's Player hand, the game participant's Bank hand is removed from the table and settled at that time as described above (632). If the game participant wins, he or she is paid on the spot at the approved and published payoff for the particular bet. If the game participant loses, his bet is collected at that time by the House, and the game participant's losing Bank hand is removed from the table. The same procedure also applies to any pending additional bets and approved side bets, if any, when results are known.

Examples of the above where the final results are known after a third card has been dealt to the House's Player hand include the following:

A. House's Player hand receives a third card on a two card total of 0-5, and the game participant is not entitled to receive a third card (two card total of 7); OR B. House's Player hand receives a third card on a two card total of 0-5 and game participant's Bank hand's starting total is 3-6, and the House draws a third card to its Player hand that does NOT entitle game participant's Bank hand to receive a third card.

Results on House's Player Hand Vs. Game Participant's Bank Hand is not Known Until Game Participant's Bank Hand Receives a Third Card.

When the final results cannot be determined after the first two cards are dealt or have not been determined after the House Player's hand is dealt a third card, the game participant's Bank hand is not removed from the table and the bet is not settled until after the game participant's Bank hand receives a third card (664). The system or the dealer determines whether the participant's Bank hand should receive a third card (665). Then the third card is dealt to game participant's Bank hand based on standard rule of baccarat (666). Examples of these situations include the following:

A. House's Player hand stands on two card total of 6 or 7, and the game participant's Bank hand's starting total is 0-5.

B. House draws to a starting Player total of 0-5, and the game participant's Bank hand totals 0-2 and is entitled to draw a third card.

C. House's Player hand receives a third card on a two card total of 0-5 and the game participant's Bank hand's starting total is 3-6, and the House draws a third card to its Player hand that does entitle game participant's Bank hand to receive a third card.

After the third card is dealt to the game participant' Bank hand, the final results are determined and the participant's Bank hand is settled as describe above (632). For example, the system can calculate a three-card score for the participants' Bank hands. The calculated three-card score for the participants' Bank hands can be compared with the score for the House's Player hand. This process is performed for each game participant's Bank hand. The process 600 ends.

Additional Bets

As described above additional bets can be implemented in a game of Baccarat where each game participant can obtain his/her own hands. In addition, additional bets can be implemented in a traditionally dealt game of Baccarat where only a single Player hand and a single Bank hand are dealt.

Figure 7:
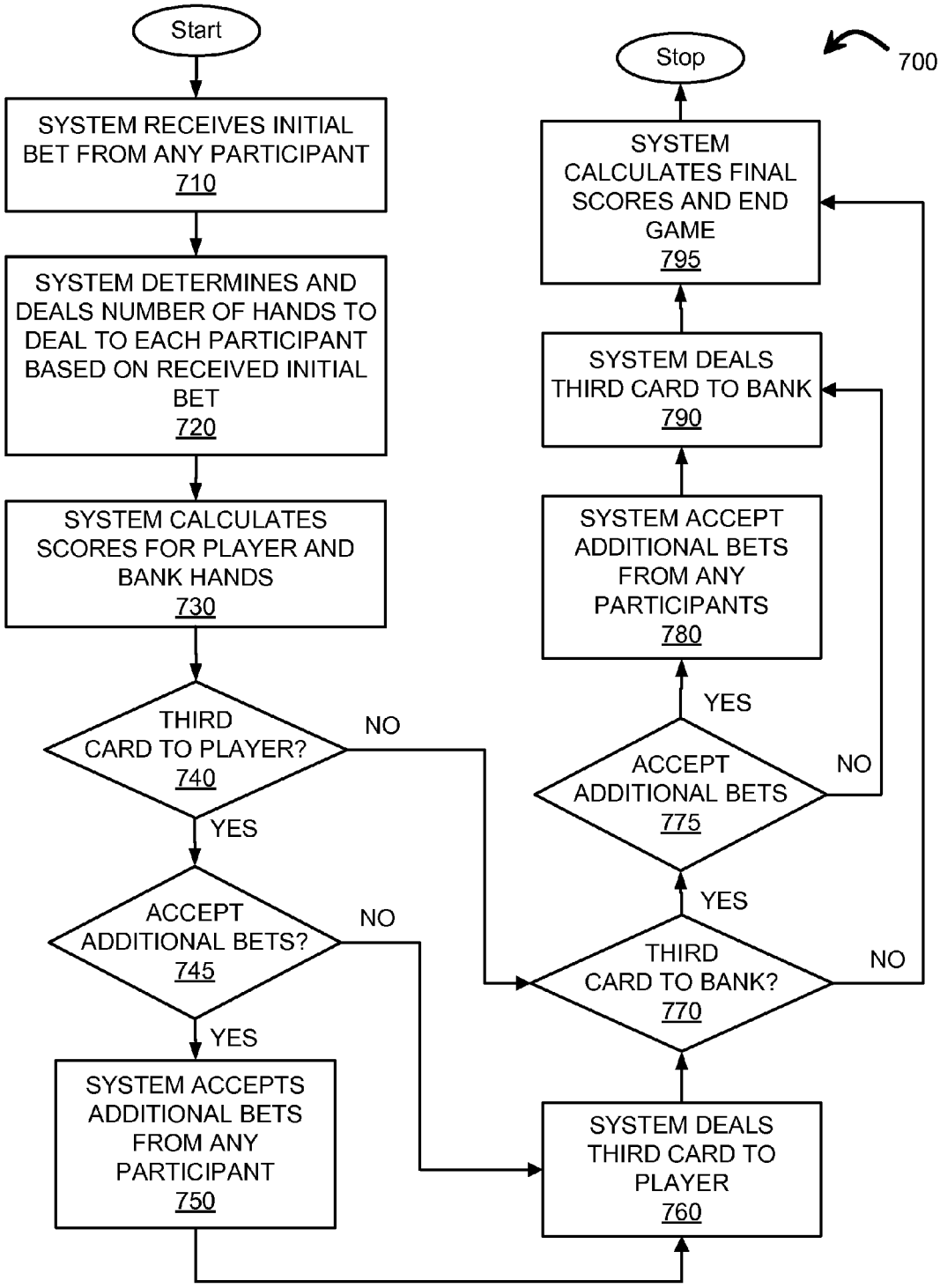
FIG. 7 shows an example process for implementing additional bets.

FIG. 7 is a process flow diagram showing an example process 700 for implementing additional bets in a traditional game of Baccarat and the non-traditional version of Baccarat described in this specification. For example, a traditional game of Baccarat starts with one or more participants placing a traditional bet (e.g., bet on Player position, bet on Bank position or bet on TIE prior to the start of the hand.) This first bet is received from one or more of the participants at 710. A dealer deals two cards to a Player position and another two cards to a Bank position at 720. A score is determined, according to the rules of Baccarat as described above, for the Player position and the Bank position at 730. At 740, a determination is made whether a third card should be dealt to the Player position and/or the Bank position by considering the following:

Player and Bank positions both stand, or

Player position stands, Bank position draws third card, or

Bank position stands, Player position draws third card, or

Player and Bank positions both draw a third card or

Player position draws third card, Bank position sometimes draws third card.

The determination at 740 above is made using the following standard Baccarat drawing rules:

1. If either the Player position or the Bank position has a total of an 8 or 9, each position stands and the hand is over. This rule overrides all other rules.
2. If both the Player position and the Bank position have a total of 6 or 7, each position stands and the hand is over. This rule overrides the rules below.
3. The Player position always stands on a 6 or 7 and draws on 0-5.
4. The Bank position always stands on a total of 7, draws on 0-5 if the Player position stands, but if the Player position is not going to stand, is guaranteed a draw on 0-2 only.
5. In cases in which the Player position is not going to stand and the Bank position has a total of 3 to 6, the determination on whether the Bank position does or does not receive a third card is based on the value of the third card received by the Player position.

In these cases the Bank position draws a third card if the Bank position's starting total is (a) 3 and the Player position's third card is an A-7, 9 or 0 value card (any card but an 8)

(b) 4 and the Player position's third card is a 2-7

(c) 5 and the Player position's third card is a 4-7

(d) 6 and the Player position's third card is a 6-7

When the determination at 740 is that a third card should be dealt to the Player position, another determination is made at 745 to decide whether to accept additional bets (e.g., based on established policy of the casino or the online gaming site). When the determination at 745 is to accept additional bets, all participants, may be allowed to place an additional bet at 750 prior to the receipt of the Player's third card at 760. When required, based on the standard Baccarat drawing rules described above, the third card is dealt to the Player position at 760. After the third card is dealt to the Player position, if the determination was not made at 740 to definitely or definitely not deal a card to the Bank position, then a determination may be required at 770 to decide whether to deal a third card to the Bank Position. In this case, the determination on whether or not a third card will be dealt to the Bank position is dependent upon the value of the third card drawn by the Player position (see, standard Baccarat drawing rules above). When the determination at either 740 or 770 is that a third card should be dealt to the Bank position, then another determination is made at 775 to decide whether additional bets are accepted (e.g., based on established policy of the casino or online gaming site). When determined that additional bets are accepted at 775, all participants may be allowed to place an additional bet at 780 prior to dealing a third card to the Bank position at 790. The third card is dealt to the Bank position at 790 when required (e.g., based on standard Baccarat drawing rules).

When the determination at 740 is that a third card should not be dealt to the Player position, then a determination is made at 740 to decide whether a third card should be dealt to Banker position. When the determination at 740 is to deal the third card to Bank position, the process 700 moves to 775 to determine if additional bets should be accepted from any participants, based on the established policy of the casino or the online gaming site, before dealing the third card to the Bank position at 790. When the determination at 775 is that additional bets are not accepted (e.g., based on established policy of the casino or the online gaming site), the process 700 moves to deal the third card to the Bank position at 790 without accepting any additional bets. Then, the final score is determined and the game ends at 795. When the determination at 770 is that a third card is not to be dealt to the Bank position (which may be independent of whether a third card was dealt to the Player position), the process 700 moves to determine the final score and the game ends at 795 without dealing third card to the Bank position or accepting additional bets. When the determination at 745 is that additional bets are not accepted (e.g., based on established policy of the casino or the online gaming site), the process 700 also moves to deal a third card to the Player position without accepting any additional bets.

In cases in which both the Bank and Player positions receive a third card (e.g., by the process 700 performing 740, 745, 750, 760, 770, 775, 780, 790 and 795), a total of two additional bets may be accepted from each participant—one at 745 and another at 775. Since accepting the additional bets at 745 and 775 may depend on the established policy of the casino or the online gaming site, the game can end at 795 with one, two or zero rounds of additional bets being accepted. As previously noted, no additional bets based on changing odds are allowed in traditional Baccarat.

Assume, for example, that after the first two cards are dealt to each position, the Player position trails the Bank position by a score of 7 to 2. In this particular case, the rules of Baccarat entitle the Player position to receive a third card. Here, each casino would have the option of accepting an additional bet from any participant at 750 (before the third card is dealt to the Player position at 760). The odds offered to participants by the casino on this additional bet would be determined by the casino based on the then current odds of a Tie hand occurring, or a win by the Bank and Player positions. In this particular case, the Bank position would be favored to win by approximately 5 to 1 (without taking into consideration the effect of the specific cards previously removed from the shoe). In this example, a casino would have pre-established and published a written policy in regard to offering additional bets on TIE, the Bank position or Player position at odds that will ensure the casino will maintain an edge, or the casino may have pre-established and published a written policy not to accept an additional bet on this particular play (or any other play).

In the example above, if the casino had established a written policy to accept additional bets on this particular play (Player 2, Bank 7), all game participants would be entitled to place an additional bet at the odds determined by the casino, which, in the case of a table game, would be based on combination of the current score and the particular cards that had already been removed from the shoe. However, in an electronic or table game in which the cards are reshuffled prior to each hand, it's likely that the odds would be determined solely by the score. For example, a table game participant who originally bet $1,000 on Player position who believes that he is going to lose the original wager on a bet on the Player position, might decide to place a $5,000 additional bet on the Bank position. In this case, if the Bank Position holds on to win and assuming the additional bet odds offered by the casino on the Bank position were 1-5, the game participant wins $950 ($1,000 less $50 commission) on the additional bet, which will cover most of the loss related to the initial bet on Player Position. However, if Player Position were to draw (on the third card dealt) a 6 or 7, the game participant who made the original bet on the Player position and the additional bet on the Bank position, would end up $4,000 worse off by winning the original $1,000 bet on the Player position but losing the additional bet of $5,000 on the Bank position.

In the additional bet example above, a game participant who originally bet $1,000 on the Bank position might decide to hedge that initial bet by making an additional bet of $500 on the Player position. In this case, if the Bank position holds on for a win, the game participant's net win will be $450 (a $1,000 win on the initial bet on the Bank position less $50 (5% commission) less the $500 loss on the additional bet made on the Player position. However, if the Player position should pull out the win by drawing a 6 or 7, the game participant still wins a net of $1,500 ($2,500 win [assuming the odds offered by the casino were 5-1] on the additional bet on the Player position less the $1,000 loss on the initial bet on the Bank position). Without the hedge bet this game participant would have lost the entire initial bet of $1,000.

In the same additional bet example discussed above, a game participant might decide to make an additional bet on TIE. In this case, prior to when the third card is dealt to the Player position, the approximate odds against a tie (without taking into consideration the effect of the specific cards previously removed from the shoe) would be 12-1 as opposed to only 8-1 if the TIE bet had been placed prior to the beginning of the hand (i.e., initial bet). In this case the casino might choose to offer odds of 12 for 1 (11 to 1). These odds are provided for illustrative purposes only.

The additional bet example discussed above in which the Player position trails the Bank position by a score of 7-2 after the first two cards have been dealt is just one of many possible. The standard baccarat drawing rules (e.g., Nos. 3-5), all of which could, depending upon the policies established by the casino, provide similar opportunities for game participants to place a new bet on either the Player position or the Bank position, increase their original bet, hedge their original bet by changing sides or make a new or additional bet on Tie. As described, each of the additional bet examples in a table game would offer odds based on a combination of the current score and the cards that have already played during the shoe. But as discussed above, in an electronic game in which the cards are reshuffled prior to each hand, it's likely that the odds would be determined solely by the score. In either case, table or electronic, these additional bet opportunities would be a first for the game of Baccarat.

The process 700 for introducing additional bet into a game of Baccarat can be implemented using the systems 100, 200 and 300 described above.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "information carrier" comprises a "machine-readable medium" that includes any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal, as well as a propagated machine-readable signal. The term "machine-readable signal" refers to any signal used to provide machine instructions and/or data to a programmable processor.

To provide for interaction with a user, the subject matter described herein may be implemented on a computer having a display device (e.g., a CRT (cathode ray tube) or LCD (liquid crystal display) monitor) for displaying information to the user and a keyboard and a pointing device (e.g., a mouse or a trackball) by which the user may provide input to the computer. Other kinds of devices may be used to provide for interaction with a user as well; for example, feedback provided to the user may be any form of sensory feedback (e.g., visual feedback, auditory feedback, or tactile feedback); and input from the user may be received in any form, including acoustic, speech, or tactile input.

The subject matter described herein may be implemented in a computing system that includes a back-end component (e.g., as a data server), or that includes a middleware component (e.g., an application server), or that includes a front-end component (e.g., a client computer having a graphical user interface or a Web browser through which a user may interact with an implementation of the subject matter described herein), or any combination of such back-end, middleware, or front-end components. The components of the system may be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Although a few variations have been described in detail above, other modifications are possible. For example, the logic flow depicted in the accompanying figures and described herein does not require the particular order shown, or sequential order, to achieve desirable results.

Also, the systems 400 and 500 described with respect to FIGS. 4 and 5 can be used to implement different versions of baccarat. For example, the systems 400 and 500 can implement a traditional game of baccarat, a traditional game of baccarat with additional bets, a baccarat game where each participant receives his/her own hands, and a baccarat game where each participant receives his/her own hands and is able to place additional bets.

In particular, the Baccarat game table layouts could be slightly altered to accommodate additional bet opportunities or additional bets could be accommodated on existing table layouts by the casino's designation of a spot on the table for those bets. For example, the spaces for placing various bets as shown in FIGS. 1 and 2 can be modified to facilitate the game play. In addition, the examples of Baccarat game table layout shown in FIGS. 1 and 2 can be represented as a BIG BACCARAT table or a MINI BACCARAT table.

The systems described in this specification can be implemented as a stand alone gaming machine, such as a video poker-like machine prevalent in a casino. In such implementations, a user interface, such as a touch screen, buttons, mouse, joystick, etc. can be provided to receive input from a user. Instead of the table, the user can designate bets, deals, etc. using the interface.

In some implementations, the gaming machine can be implemented as a multiplayer gaming machine. The systems described in this specification can be duplicated as a multiplayer gaming machine with multiple display units, one for each participant. Each display unit can include one or more user interfaces described above for receiving user input that indicate the type of bets, amount of bets, and when to deal the cards.

In some implementations, the multiplayer gaming machine can be implemented to replicate all components as shown in FIGS. 4, 5 and 7*a* above. However, the dealer can be replaced by the analysis system, which can deal the necessary virtual cards electronically. The deal virtual cards can be displayed on the individual display units 712, 722 and 724. In such implementations, the participants can duplicate a table game by sitting at a baccarat table. The only difference will be the virtual cards. To mimic the experience of receiving actual playing cards, the multi-player gaming device can implement additional display units shaped like individual cards. For example, the visual indicators 752 and 754 can be used to display the image of each virtual card dealt.

The visual indicators 752 and 754 can be implemented as playing card sized display units mounted to the table so as to enable the participants to view the images of the virtual cards dealt. Alternatively, the visual indicators 752, 754 can be implemented as playing card sized portable display units that the participants can grab and hold in their hands. In this way, the participants can fully duplicate the table game.

In some implementations, these display units can be implemented as other display units in addition to the visual indicators 752, 754.

Also, while it would be theoretically possible for a casino to allow additional bets prior to each draw during the hand, live table games require the casino to consider the practicality of being able to offer bets that are convenient to place, track and pay off at the table. Accordingly, additional bets prior to every possible draw would likely, but not necessarily, be limited to electronic or on-line versions of Baccarat.

At live table games in a casino, the implementations described may be limited to additional bets on the final draw of the hand. In such implementations, casinos may choose to develop rules and procedures that will allow them to offer certain additional bets without utilizing technology to determine the changing odds in real-time.

In the examples of additional bets described above, the actual odds offered to the game participant by the casino could be adjusted based on the casino's preferences, but the examples chosen illustrate the attractiveness and simplicity of the additional bet concept from both the casino's and the game participant's point of view.

What is claimed is:

1. A gaming system, comprising:

a card-game table comprising visually defined regions on a surface of the card-game table to accommodate one or more card hands of each of one or more participants in addition to one or more separate card hands of a house entity;

an analysis system associated with the card table, wherein the analysis system is configured to perform the following:

receive bet data indicative of bets placed by the one or more participants;

determine whether to deal an initial participant player hand, an initial participant bank hand, or both, to each of the participants based on the received bet data;

receive card data comprising a value associated with each card that is dealt to the participants and to an initial house entity player hand and an initial house entity bank hand;

process the received card data to calculate scores and odds relating to any initial participant player hands or initial participant bank hands that were dealt, plus the house entity initial player hand and the house entity initial bank hand, in accordance with the scoring and odds associated with a game of baccarat; and generate an output signal indicative of the calculated scores and odds; and a display device in communication with the analysis system to receive the generated output signal and display the received output signal as at least a visual indication of the calculated scores and odds.

2. The system of claim 1, further comprising a card reader in communication with the analysis system, wherein the card reader is configured to perform operations comprising:

identify the value associated with each card dealt; and send the data representing the identified value to the analysis system.

3. The system of claim 1, wherein the analysis system is further configured to perform operations comprising:

determining whether each initial participant player hand should receive another card;

determining whether the initial house entity bank hand should receive another card;

calculating a final score of each participant player hand and for the house entity bank hand; and determining a winner between each participant player hand and the house entity bank hand.

4. The system of claim 1, wherein the analysis system is configured to receive an additional bet after any participant player hands have been dealt.

5. The apparatus of claim 4, wherein the analysis system is further configured to receive a second additional bet after one of the initial participant player hands has been dealt an additional card.

6. The system of claim 1, wherein the display device comprises a liquid crystal display positioned at or near the baccarat table so as to be viewable by the participants.

7. The system of claim 1, further comprising one or more remote devices in communication with the analysis system to receive the generated output signal.

8. The system of claim 7, wherein the one or more remote devices are configured to perform operations comprising:

receive an input from one or more remote participants, wherein the input represents a request to place a bet on a one of the card hands of each participant and the house entity; and send the input representing the request to the analysis system.

9. The system of claim 7, wherein the one or more remote devices are located at a location remote from the card-game table and in communication with the analysis system over a network connection.

10. The system of claim 1, wherein the display device comprises a separate display unit for each participant.

11. The system of claim 10, wherein the separate display unit for each participant each comprises a touch-screen to receive bets from a respective participant, wherein the received bets comprise bets on any of the hands dealt at the card-game table.

12. The system of claim 1, wherein the display device comprises multiple display regions configured to display the output signal so as to provide the scores and odds for each participant in a separate one of the display regions viewable by each participant.

13. The system of claim 1, further comprising one or more input sensors associated with one or more visually defined regions on the surface of the card-game table to detect bets placed by the one or more participants and to generate the bet data.

14. The system of claim 13, wherein at least one of the one or more input sensors comprises a pressure sensor to detect a presence of betting chips.

15. The system of claim 13, further comprising one or more visual indicators associated with one or more visually defined regions on the surface of the card-game table to provide one or more visual indications of whether each participant should receive an initial player hand, an initial bank hand, or both.

16. The gaming system of claim 1, further comprising:

an image capture device in communication with the analysis system to capture live video data of a card game at the card-game table; and one or more slot machines to receive the captured live video data.

17. The system of claim 16, wherein the one or more slot machines are configured to receive bets from a slot machine users based on the received video data.

18. The system of claim 16, wherein the image capture device provides the card data to the analysis system.

19. The apparatus of claim 1, wherein the analysis system is further configured to perform operations comprising:

determining whether the initial house entity player hand should receive another card;

determining whether any initial participant bank hands should receive another card;

calculating a final score of the house entity player hand and any participant bank hands; and determining a winning hand between the house entity player hand and each participant bank hand.

20. The apparatus of claim 19, wherein the analysis system is further configured to perform operations comprising:

receiving an additional bet after the initial participant player hands have been dealt and before another card is provided to the initial house entity player hand.

21. The apparatus of claim 20, wherein the analysis system is further configured to perform operations comprising:

receiving a second additional bet after the initial house entity player hand has received an additional card.

22. A method performed by an electronic processing system, comprising:

receiving betting data relating to one or more bets from one or more participants, the data provided by one or more input sensors;

determining whether to deal an initial participant player hand, an initial participant bank hand, or both, to each of the participants based on the betting data;

providing an electronic signal to a display device signaling a dealer to deal the initial participant player hand, the initial participant bank hand, or both, to each participant depending on the initial bets received from the participants;

detecting card data as the hands are provided to the participants and to an initial house entity player hand and an initial house entity bank hand;

process the received card data to calculate scores and odds relating to any initial participant player hands or initial participant bank hands that were dealt, plus the initial house entity player hand and the initial house entity bank hand, in accordance with the scoring and odds associated with a game of baccarat; and providing an electronic signal indicative of the calculated scores and odds to at least one participant.

23. The method of claim 22, further comprising:

determining whether each initial participant player hand should receive another card;

determining whether the initial house entity bank hand should receive another card;

calculating a final score of each participant player hand and for the house entity bank hand; and determining a winning hand between each participant player hand and the house entity bank hand.

24. The method of claim 22, further comprising:

receiving an additional bet from the one or more input sensors after the participant player hands have been deal.

25. The method of claim 24, further comprising:

receiving a second additional bet from the one or more input sensors after one of the initial participant player hands has been dealt an additional card.

26. The method of claim 22, further comprising:

determining whether the initial house entity player hand should receive another card;

determining whether any initial participant bank hands should receive another card;

calculating a final score of the house entity player hand and any participant bank hands; and determining a winning hand between the house entity player hand and each participant bank hand.

27. The method of claim 22, comprising:

receiving an additional bet from the one or more input sensors after the participant player hands have been dealt and before another card is provided to the initial house entity player hand.

28. The method of claim 27, further comprising:

receiving a second additional bet from the one or more input sensors after the initial house entity player hand has received an additional card.

* * * * *